US005732953A

United States Patent [19]

Tamura

[11] Patent Number: 5,732,953

[45] Date of Patent: Mar. 31, 1998

[54] BOXING GAME MACHINE

[75] Inventor: Yuji Tamura, Kobe, Japan

[73] Assignee: Konami Co., Ltd., Hyogo-ken, Japan

[21] Appl. No.: 579,032

[22] Filed: Dec. 18, 1995

[30] Foreign Application Priority Data

Dec. 20, 1994 [JP] Japan ..... 6-317226

[51] Int. Cl.[6] ..... A63H 13/06

[52] U.S. Cl. ..... 273/440.1; 446/320; 446/334; 446/366

[58] Field of Search ..... 446/320, 334, 446/335, 336, 352, 353, 359, 365, 366; 273/440.1

[56] References Cited

U.S. PATENT DOCUMENTS

| | | | |
|---|---|---|---|
| 1,781,307 | 11/1930 | Veronda | 446/335 |
| 2,002,026 | 5/1935 | Fairgrieve | 446/336 |
| 2,633,669 | 4/1953 | Churus | 446/353 |
| 2,716,840 | 9/1955 | Armstrong | 446/334 |
| 2,760,306 | 8/1956 | Pelletier | 446/334 |
| 3,235,259 | 2/1966 | Glass et al. | 273/440.1 |
| 3,856,304 | 12/1974 | Matsumoto | 446/334 |
| 3,864,870 | 2/1975 | Breslow et al. | 446/334 |
| 3,927,883 | 12/1975 | Bosley et al. | 446/334 |
| 4,091,563 | 5/1978 | Noble et al. | 273/440.1 |
| 4,609,195 | 9/1986 | Ham | 273/440.1 |
| 4,844,461 | 7/1989 | Namanny et al. | 273/440.1 |
| 5,009,424 | 4/1991 | Harth et al. | 273/440.1 |
| 5,458,523 | 10/1995 | Aoki et al. | 273/440.1 |

FOREIGN PATENT DOCUMENTS

| | | | |
|---|---|---|---|
| 683154 | 6/1930 | France | 446/320 |
| 446416 | 10/1928 | Germany | 446/334 |
| 02307487 | 12/1990 | Japan . | |

*Primary Examiner*—Michael A. Brown
*Assistant Examiner*—Jeffrey D. Carlson
*Attorney, Agent, or Firm*—Jordan & Hamburg

[57] ABSTRACT

A boxing game machine in which a pair of boxer dummies are opposed to each other, each boxer dummy having at least one extensible arm, includes: an extender which drives the extension of the arm; a rotary unit which is rotatable about a substantially horizontal axis and carries at least one of the boxer dummies; and an operative member which is connected with the rotary unit and provided with a switch for switching over the drive of the extender, the operative member being operable to rotate the rotary unit about the horizontal axis. By rotating the operative member about the substantially horizontal axis together with the rotary unit while gripping the operative member, the boxer dummy connected with the rotary unit rotates about the same axis.

23 Claims, 19 Drawing Sheets

BOXING GAME MACHINE

BACKGROUND OF THE INVENTION

This invention relates to a boxing game machine provided with opposing boxer dummies.

A known game machine provided with opposing boxer dummies is disclosed in Japanese Unexamined Patent Publication No. 2-307487. In this game machine, the base ends of rotatable arms are mounted on the shoulders of the respective boxer dummies, and the rotatable arms are rotated by the extension and contraction of an extension mechanism. The extension mechanism is connected with a pumping mechanism in gloves via air supply pipes. When a player simulates a boxing action while holding the gloves, the rotatable arms move accordingly to punch and/or defend.

In the above game machine, although the boxer dummies can punch or defend by operating the gloves, the posture of the dummies is basically fixed all the time. It is not possible to move the dummies themselves to the left or right and to change the facing directions of the dummies. As a result, the simulated boxing game lacks movements.

The trunk of the dummy automatically swings to the left and right when the punch is given in the above game machine. However, this swinging action is only performed in synchronism with the punching action, and the posture of the dummy cannot be controlled at the player's free will. Further, a manufacturing cost of this game machine is relatively high because of a complicated mechanism to cause the swinging action upon the punching action.

SUMMARY OF THE INVENTION

It is an object of the present invention to provide a boxing game machine which has overcome the problems residing in the prior art.

It is another object of the present invention to provide a boxing game machine which can simultaneously perform a punching operation and freely changing the posture of a boxer dummy with a simple mechanism.

Accordingly, the present invention is directed to a boxing game machine in which a pair of boxer dummies are opposed to each other, each boxer dummy having at least one extensible arm, comprising: an extender which drives the extension of the arm; a rotary unit which is rotatable about a substantially horizontal axis and carries at least one of the boxer dummies; and an operative member which is connected with the rotary unit and provided with a switch for switching over the drive of the extender, the operative member being operable to rotate the rotary unit about the horizontal axis.

It may be appreciated to connect the operative member with the rotary unit rotatably about a first substantially vertical axis, connect the boxer dummy with the rotary unit rotatably about a second substantially vertical axis, and provide a transmission mechanism which transmits a torque of the operative member about the first substantially vertical axis to the boxer dummy. The first and second substantially vertical axes are preferably arranged on a vertical plane passing a player. The transmission mechanism may be constructed by a drive shaft provided in the operative member and rotatably mounted on the rotary unit, the drive shaft extending along the first substantially vertical axis; a driven shaft provided in the boxer dummy and rotatably mounted on the rotary unit, the driven shaft extending along the second substantially vertical axis; a drive wheel fixedly attached to the drive shaft; a driven wheel fixedly attached to the driven shaft; and a transmission member provided with the drive wheel and the driven wheel for transmitting a torque of the drive wheel to the driven wheel.

The rotary unit may be constructed by a connecting portion which has a specified stiffness and connects the boxer dummy and operative member; and two rotatable support shafts which are fixedly attached at two opposite ends of the connecting portion and rotatably supported on a support frame provided in the game machine, the respective axes of the two rotatable support shafts being on the substantially horizontal axis.

The connecting portion may be provided with a drive shaft provided in the operative member and mounted on one of the rotatable support shafts rotatably about a first substantially vertical axis; a driven shaft provided in the boxer dummy and mounted on the other rotatable support shafts rotatably about a second substantially vertical axis; and a transmission mechanism which connects the drive shaft and the driven shaft, and transmits a torque of the drive shaft about the first substantially vertical axis to the driven shaft. The first and second substantially vertical axes are arranged on a vertical plane passing a player. The transmission mechanism may be constructed by a drive arm provided on the drive shaft; a driven arm provided on the driven shaft; a link member having two ends rotatably connected to the drive and driven arms, respectively.

It may be appreciated that both arms of the boxer dummy are made to be extensible, the extender includes two extending drivers for driving the extensions of the both arms, respectively, the switch includes two switching portions for switching over the two extending drivers, respectively, and the operative member has two grip portions provided with the two switching portions, respectively.

It may be appreciated to provide a damage detector on a position of each boxer dummy that is opposed to the other boxer dummy for detecting a hitting of the boxer; and a determinator for determining a winner based on a detection signal from the damage detector. Also, there may be preferably provided a plurality of damage detectors at different positions of each boxer dummy to differentiate damages in accordance with positions.

The extensible arm may be provided with a pantograph type link mechanism attached on a main body of each boxer dummy. The extender may be constructed by a rack connected with a link member closest to the boxer dummy amongst all link members of the link mechanism, the rack being reciprocatingly movable in a straight line to contract and extend the link mechanism; a pinion in mesh with the rack; a drive motor for rotating the pinion to move the rack; an extension detector which detects an extended state of the link mechanism; an extension controller which controls the drive motor in accordance with a detection signal of the extension detector to contract the link mechanism when the switch is not operated, and extend the link mechanism by a specified stroke and to contract immediately thereafter when the switch is operated. Also, the respective link members of the link mechanism may be preferably formed in such a curved shape that they outwardly bulge when the link mechanism is extended.

In this game machine, the operative member and the boxer dummy are connected by the rotary unit rotatable about the substantially horizontal axis. Accordingly, by rotating the operative member about the substantially horizontal axis together with the rotary unit while gripping the operative member, the boxer dummy connected with the rotary unit rotates about the same axis. More particularly, the boxer dummy can be pivoted to the left and right by rotating the operative member. This movement of the boxer dummy is effective for a punch and a defense. In other words, the inclining direction of the boxer dummy can be freely changed to change the punching direction and avoid a punch from the opponent. Further, by operating the switch provided in the operative member while gripping the operative member, the arm of the boxer dummy can be extended to give a punch while moving the boxer dummy.

There is further provided the transmission mechanism which transmits a torque of the operative member about the first substantially vertical axis to the boxer dummy. Accordingly, in addition to the torque about the horizontal axis, the boxer dummy can be rotated in the vertical axis. Consequently, the facing direction of the boxer dummy can be more fi-eely changed. This will increase the game performance and then give more excitement to the player. The transmission mechanism using the drive and driven wheels makes it possible to selectively set the rotation speed of the boxer dummy. Also, the first and second substantially vertical axes are arranged on a plane passing a player. Accordingly, the player can enjoy the game more excitingly because he/she more easily pretends to be the boxer dummy.

The rotary unit is constructed by the connecting portion and two rotatable support shafts fixedly attached at two opposite ends of the connecting portion. This will facilitate the construction of the rotary unit. The transmission mechanism using the link member will ensure a simplified construction and reduce the weight of the rotary unit.

Further, since the pair of extension switches corresponding to the both arms are provided in the corresponding grips of the operative member, the player can easily move the boxer dummy itself and perform a punching operation at the same time, while stably holding the grips with both hands.

The provision of the damage detector will make the simulated boxing game more excited and thrilling. Also, since damages differ depending on where the punch hits, a more complicated game strategy is required. This further enriches the content of the game.

The arm is provided with the pantograph type link mechanism. The pantograph type link mechanism is contracted and extended by moving the rack connected to the base link member. Accordingly, upon operating the extension switch, the drive motor is driven, thereby causing the rack to make a reciprocating movement. As a result, the arm of the boxer dummy automatically extends by the specified stroke and, thereafter, contracts to its original position. Therefore, only by operating the extension switch, a punching operation almost identical to an actual punching operation can be automatically reproduced. Further, the arm is not kept extended.

The respective link members constituting the link mechanism form outwardly bulging curves when the link mechanism is extended. With such link members, points of connection where the respective links are connected are allowed to be round, thereby decreasing a probability that the arms get entangled.

These and other objects, features and advantages of the present invention will become more apparent upon a reading of the following detailed description and accompanying drawings.

DETAILED DESCRIPTION OF THE PREFERRED EMBODIMENTS OF THE INVENTION

One embodiment of the invention is described with reference to FIGS. 1 to 16.

Figure 1:
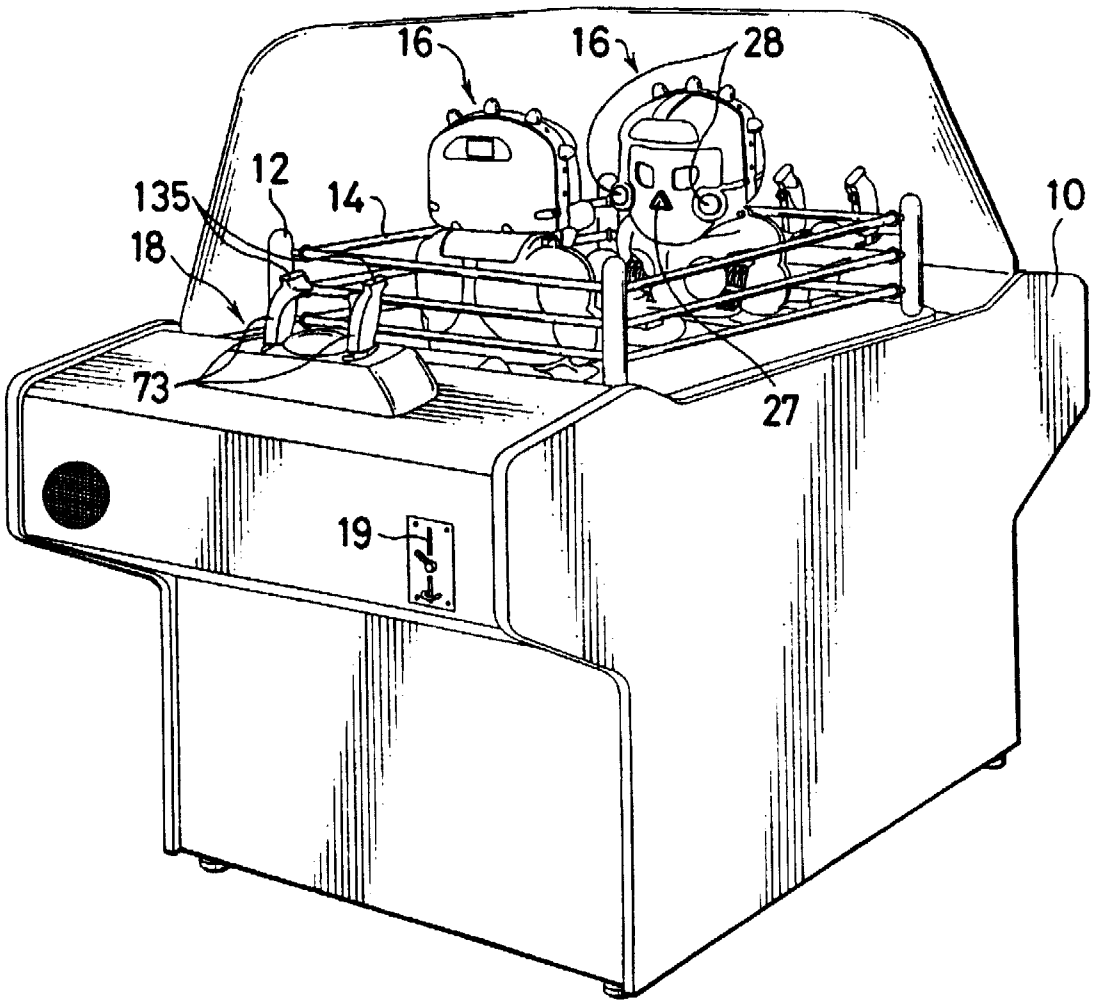
FIG. 1 is a perspective view showing an overall construction of a boxing game machine embodying the present invention.
Figure 2:
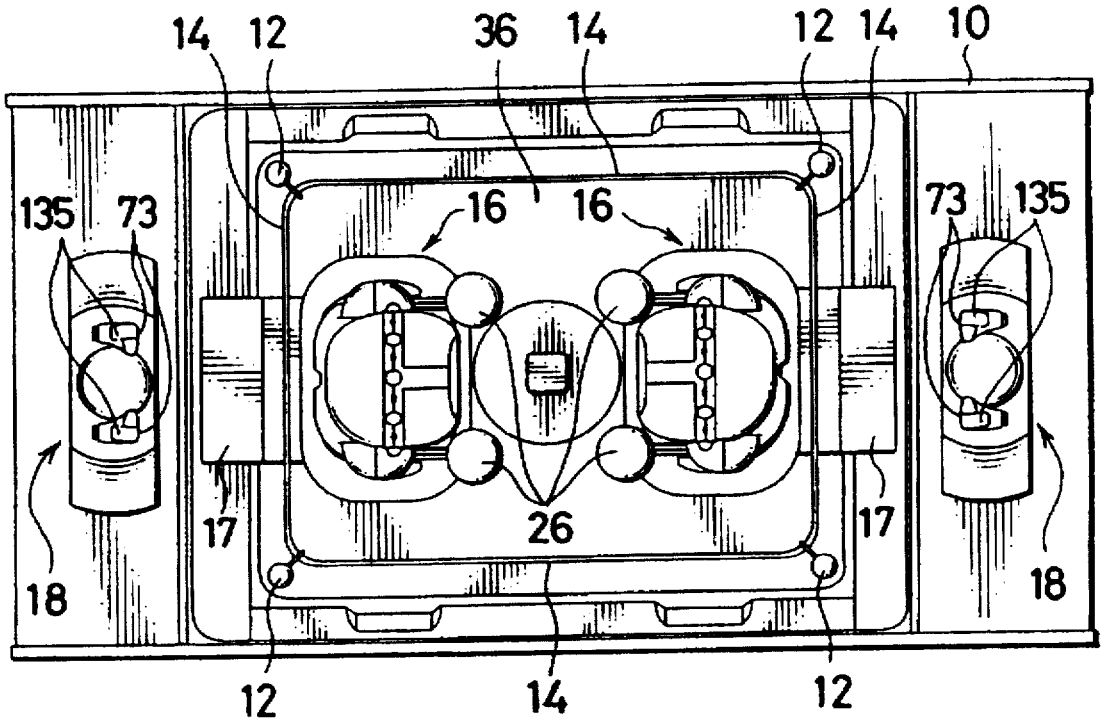
FIG. 2 is a plan view of the game machine.

A boxing game machine (hereinafter, merely "game machine") shown in this embodiment is provided with a housing 10 shown in FIGS. 1 and 2. A ring encircled by corner posts 12 and side ropes 14 is formed on the upper surface of the housing 10. A pair of boxer dummies 16 are opposed to each other within the ring. A winning/loss indicator 17 and an operation handle (operative member) 18 are provided at each of the ringsides. A coin slot 19 is formed in the side surfaces of the housing 10.

Figure 3B:
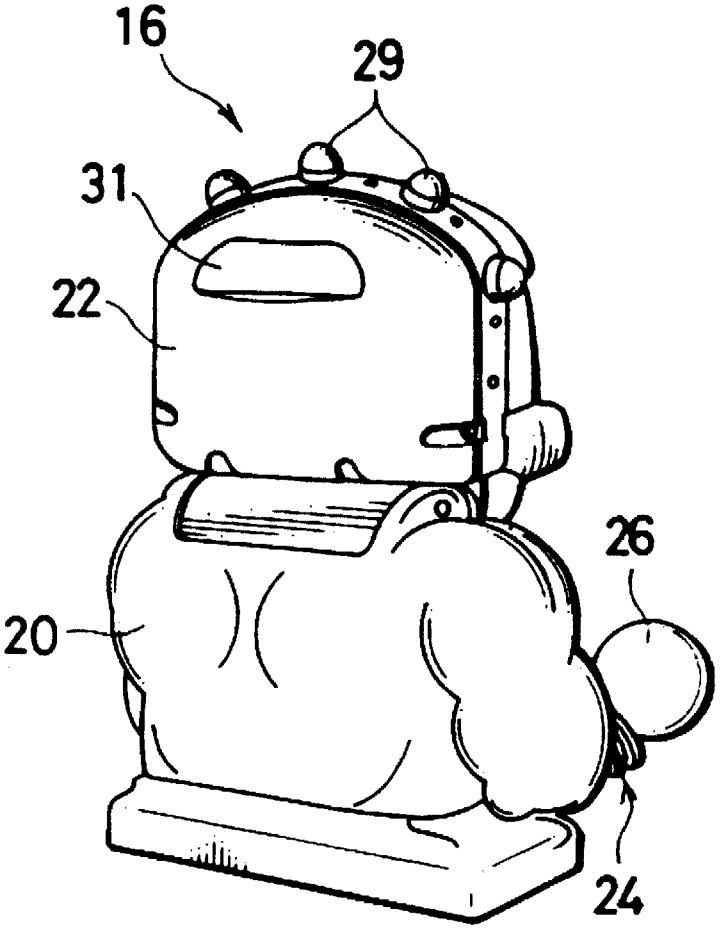
FIGS. 3A and 3B are perspective views showing a boxer dummy used in the game machine when viewed from front and behind, respectively.
Figure 3A:
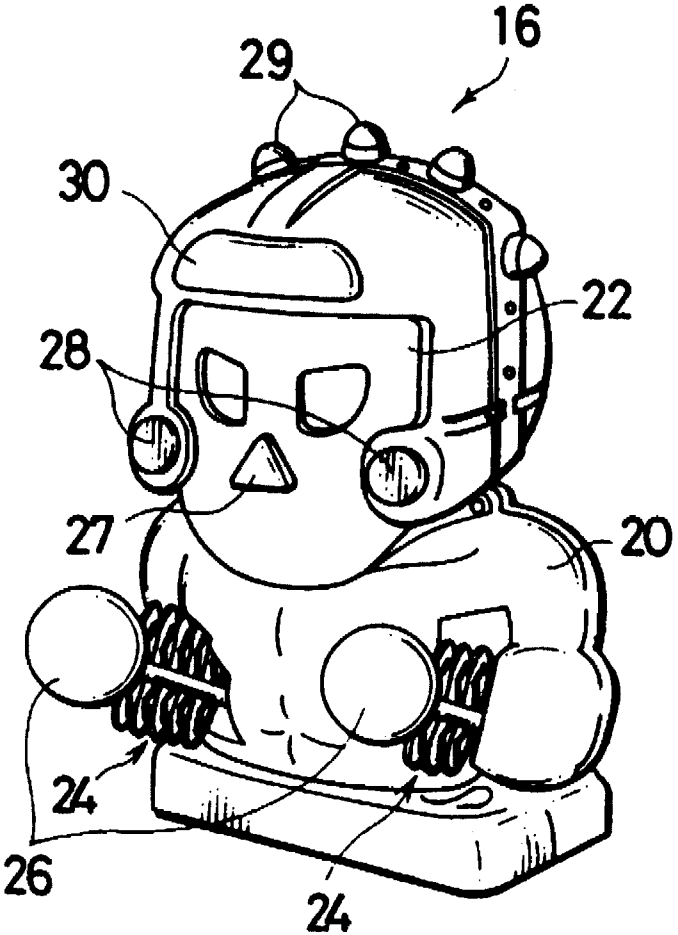

As shown in FIGS. 3A and 3B, each boxer dummy 16 includes a trunk 20 and a head 22. Both arms of the boxer dummy 16 are extensible. Specifically, a glove 26 is connected with each elbow via a pantograph type link mechanism 24 to be described later.

In the head 22, a first damage switch 27 and second damage switches 28 are disposed in portions corresponding to the nose and the cheeks, respectively. The damage switches 27 and 28 emit light upon receipt of a punch and output a detection signal representative of having received the punch.

A plurality of illumination lamps 29 are arranged in line at the top of the head 22. Life counter displays 30 and 31 are disposed on front and rear head portions, respectively. The displays 30 and 31 display life count values which are suitably decreased during the play or game in a real-time manner.

Next, the frame structure of the game machine is described.

Figure 4:
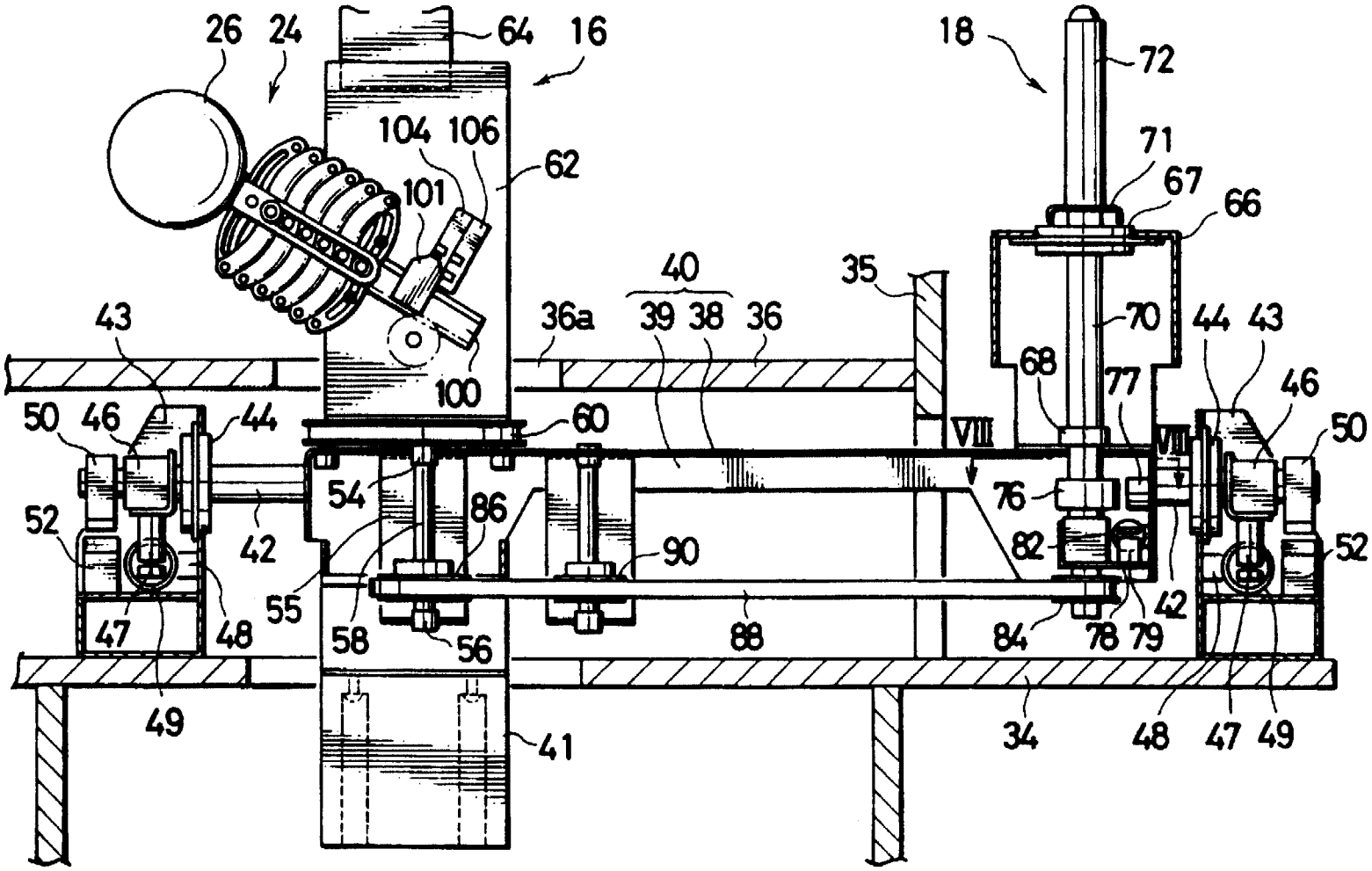
FIG. 4 is a side view in section of a frame structure of the game machine.

As shown in FIG. 4, a horizontal plate 34 is held at a specified height. Side plates 35 are placed on the horizontal plate 34, and a ring floor board 36 is placed in an area encircled by the side plates 35. A pair of carriage housings 40 are so disposed on the horizontal plate 34 as to correspond to the respective boxer dummies 16.

Each carriage housing 40 linearly extends from the bottom position of the boxer dummy 16 to a position below the handle 18. One end of the carriage housing 40 is connected with the boxer dummy 16 and the other end thereof is connected with the handle 18. The carriage housing 40 includes a ceiling plate 38 and plates 39 extending downward from the peripheries of the ceiling plate 38. Horizontal rotatable support shafts 42 coaxially project at the inner (left end in FIGS. 4 and 5) and outer (right end in FIGS. 4 and 5) ends of the carriage housing 40. The rotatable support shafts 42 and the carriage housings 40 form a rotary unit according to the invention. The entire rotary unit is rotatable about an axis parallel to a line connecting the rotatable support shafts 42.

Indicated at 41 in FIG. 4 is a weight connected with the carriage housing 40 so as to stabilize the torque thereof.

Figure 6:
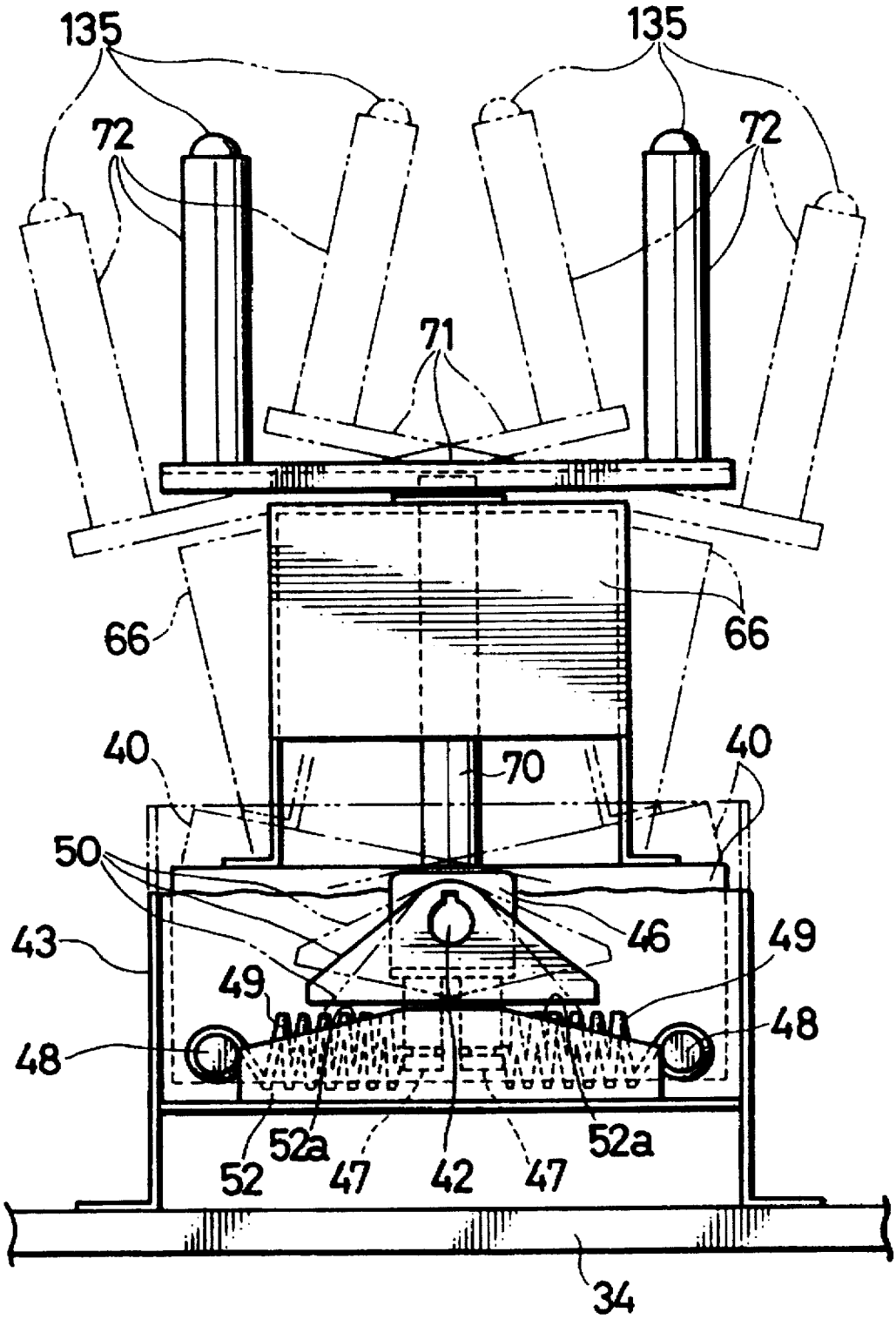
FIG. 6 is a front view of the frame structure.

The torque mechanism is described in more detail. Both rotatable support shafts 42 are rotatably supported by brackets 43 standing upright on the horizontal plate 34 via bearings 44. At an outer end of each rotatable support shaft 42, a spring coupling bracket 46 shown in FIG. 6 is so secured as not to be rotatable with respect to the rotatable support shaft 42. A pair of laterally arranged spring coupling pins 47 extend downward from the spring coupling bracket 46. Likewise, spring coupling pins 48 project in a horizontal direction from the bracket 43. The pins 47 and 48 are coupled with each other via corresponding tension coil springs 49. When no external force is exerted, the entire rotary unit is held in its neutral position due to tension forces of the tension coil springs 49.

A substantially isosceles-triangularly shaped rotatable stopper 50 is mounted at a further outer end of each rotatable support shaft 42. On the other hand, in a position right below the rotatable stopper 50, a fixed stopper 52 of urethane rubber or like material stands upright on the horizontal plate 34. The fixed stopper 52 has a pentagonal shape having a pair of left and right slanted surfaces **52*a*. The rotary unit, the boxer dummy 16 and the handle 18 are integrally rotatable to the left or right until the lower surface of the rotatable stopper 50 comes into contact with one of the slanted surfaces 52*a* (positions indicated at phantom line in FIG. 6**).

Figure 7A:
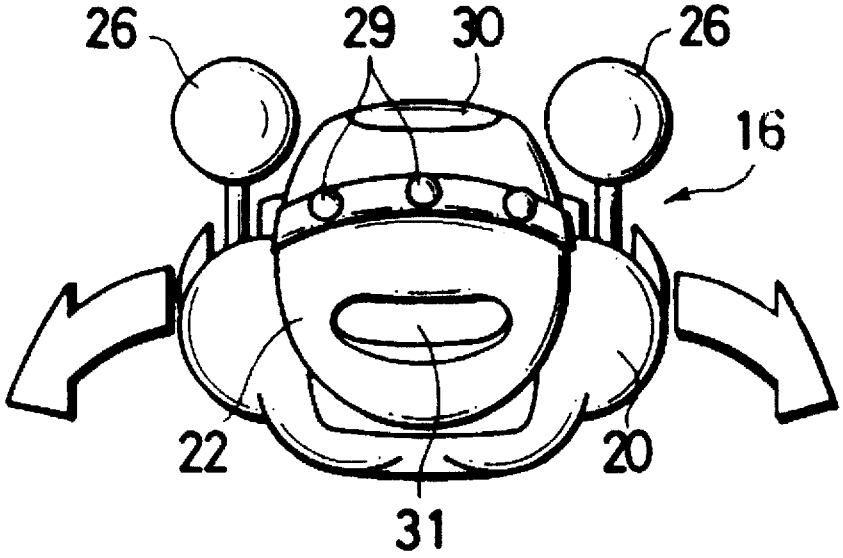
FIG. 7A is a perspective view showing inclining directions of the boxer dummy to the left and right.
Figure 7B:
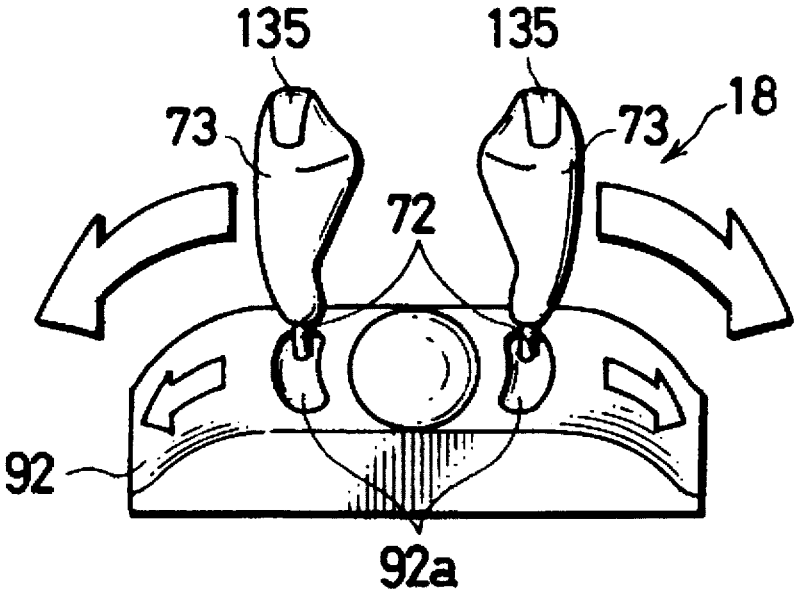
FIG. 7B is a perspective view showing operating directions of a handle corresponding to the inclining movement of the boxer dummy.

More specifically, if the handle 18 is rotated to the left or right about the horizontal axis as shown in FIG. 7B, the boxer dummy 16 connected with the handle 18 via the rotary unit is rotated by the same angle.

Next, the coupling construction for coupling the boxer dummy 16 and the handle 18 with the carriage housing 40 is described.

A bracket 55 is mounted at an end portion corresponding to the dummy 16 in the carriage housing 40. Bearings 56 and 54 are mounted on a lower portion of the bracket 55 and the ceiling plate 38 for rotatably supporting a vertically extending driven shaft 58 about its axis. A dummy table 60 is fixed at the upper end of the driven shaft 58, and a dummy trunk frame 62 stands upright on the dummy table 60. The trunk frame 62 projects upward through a through hole **36*a* formed in the ring floor board 36. A dummy head frame 64 is mounted on the upper portion of the trunk frame 62**.

A bracket 66 stands upright at an end of the carriage housing 40 corresponding to the handle 18. Bearings 67 and 68 are mounted on an upper portion of the bracket 66 and the ceiling plate 38 of the carriage housing 40 for rotatably supporting a vertically extending drive shaft 70 about its axis. A handle base plate 71 extending in a lateral direction of FIG. 6 is secured at the upper end of the drive shaft 70, a lever 72 stands upright at each of the opposite lateral ends of the base plate 71. Left and right grips 73 shown in FIG. 7 are formed by suitably coating the levers 72 with covers.

The driven shaft 58 and the drive shaft 70 are arranged on a vertical plane passing the player to give easy handling to the player. Also, this array will make it easier that the player pretends to be his/her boxer dummy.

Figure 8:
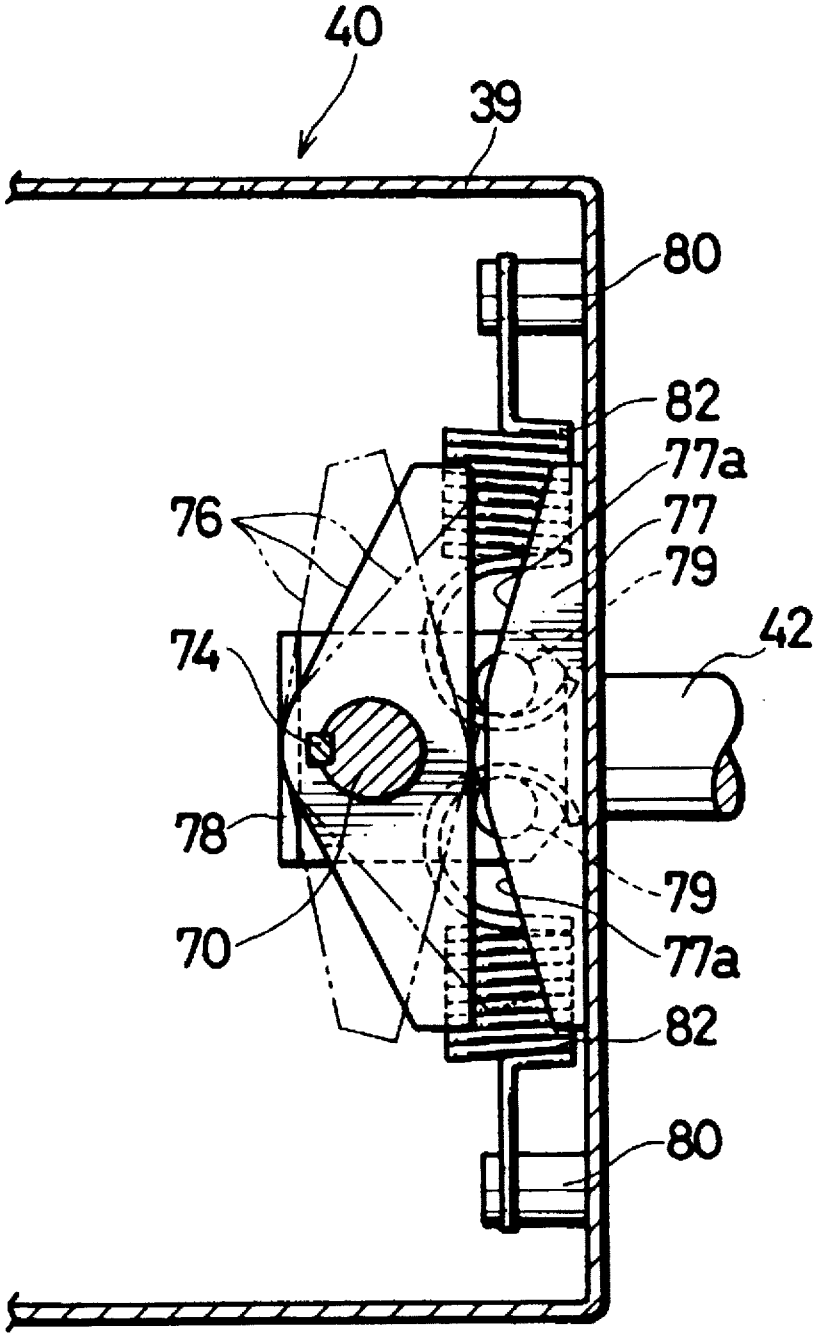
FIG. 8 is a section view taken along the line VIII—VIII in FIG. 4.

A rotatable stopper 76 is secured on a portion of the drive shaft 70 below the ceiling plate 38 via a key 74 shown in FIG. 8 such that it is not rotatable with respect to the drive shaft 70. The rotatable stopper 76 has a substantially isosceles-triangular shape. On the other hand, a fixed stopper 77 of urethane rubber or like material is secured on one side plate 39 of the carriage housing 40 in a position at the side of the rotatable stopper 76. The fixed stopper 77 has a pentagonal shape having a pair of left and right slanted surfaces **77*a*. The drive shaft 70 and the handle 18 are rotatable to the left or right until the vertical extending side surface of the rotatable stopper 76 comes into contact with one of the slanted surfaces 77*a* (positions indicated at phantom line in FIG. 8**).

A spring coupling bracket 78 is secured on the drive shaft 70 right below the rotatable stopper 76 such that it is not rotatable with respect to the drive shaft 70. A pair of left and right spring coupling pins 79 are mounted upright on the bracket 78, and a pair of left and right spring coupling pins 80 project horizontally and inwardly from the one side plate 39 of the carriage housing 40. The spring coupling pins 79 and 80 are coupled via tension coil springs 82. When no external force is exerted, the drive shaft 70 and the rotatable stopper 76 are held in their neutral positions indicated at the solid line in FIG. 8 (an angular position where the levers 72 accurately extend in the vertical direction) due to tensile forces of the tensile coil springs 82.

Figure 5:
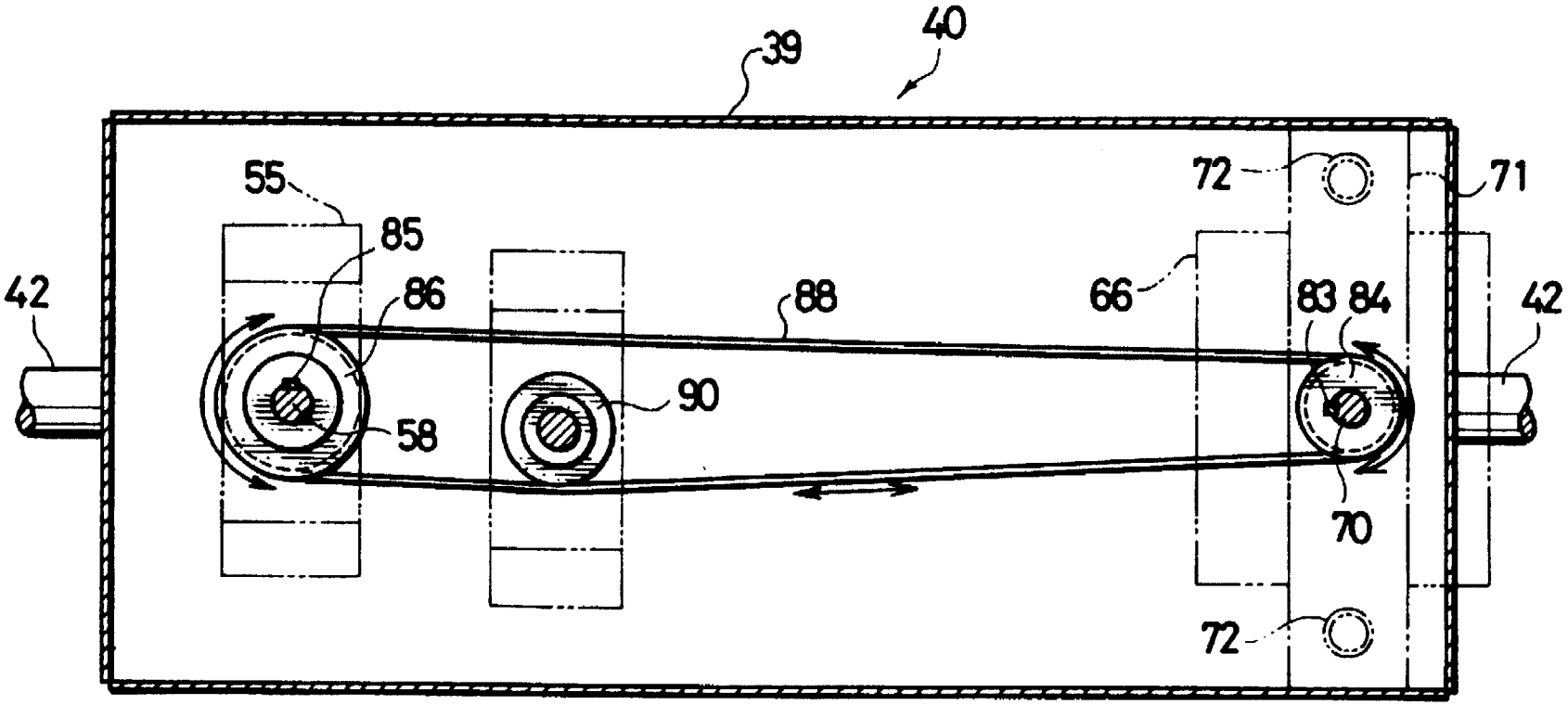
FIG. 5 is a plan view in section showing the interior of a carriage housing provided in the game machine.

A pulley 84 is secured on the lower end of the drive shaft 70 via a key 83 shown in FIG. 5 such that it is not rotatable with respect to the drive shaft 70. Similarly, a pulley 86 is secured at the lower end of the driven shaft 58 via a key 85 shown in FIG. 5. The pulleys 84 and 86 are connected via a belt 88. The pulleys 84 and 86 and the belt 88 form a transmission mechanism for transmitting a torque of the drive shaft 70 to the driven shaft 58 to rotate the driven shaft 58 in synchronism with the rotation of the drive shaft 70.

Indicated at 90 in FIGS. 4 and 5 is a tension pulley mounted in the transmission mechanism.

Figure 9A:
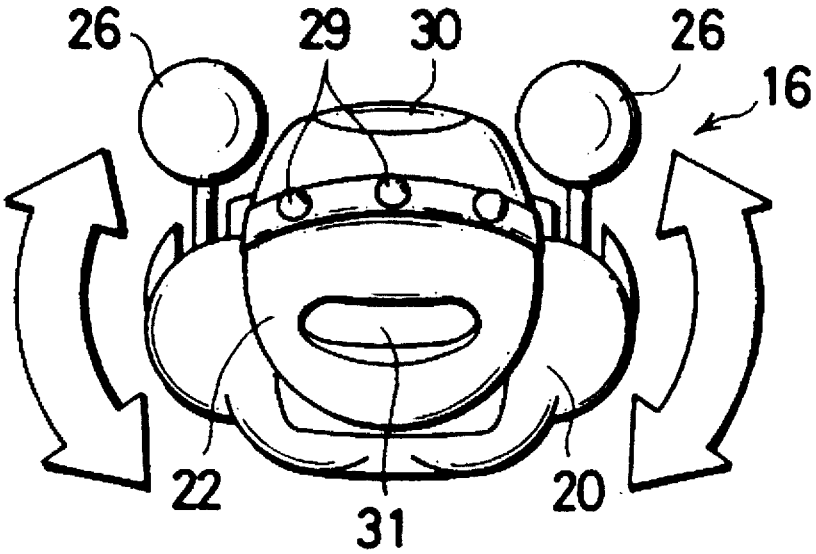
FIG. 9A is a perspective view showing rotating directions of the boxer dummy to the left and right.
Figure 9B:
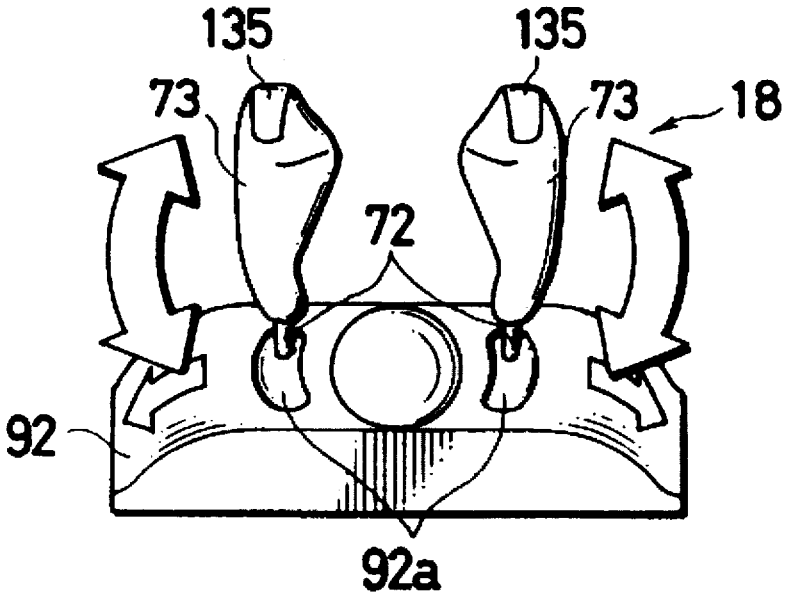
FIG. 9B is a perspective view showing operating directions of the handle corresponding to the rotating movement of the boxer dummy.

A handle cover 92 for covering the lower end portions of the levers 72 as shown in FIGS. 7B and 9B is secured on the upper surface of the bracket 66. The handle cover 92 is formed with through holes 92*a* having an arcuate shape corresponding to a trace of rotation of the lever 72 about the drive shaft 70. The respective levers 72 project through the through holes 92*a*. As shown in FIG. 9B, by rotating the handle 18 about the vertical axis while holding the left and right grips 73 formed by the levers 72, the boxer dummy 16 rotates about the vertical axis (i.e. the boxer dummy 16 is directed toward the left and right) as shown in FIG. 9A.

The extension mechanism for extending and contracting both arms of each boxer dummy 16 is described with reference to FIGS. 10 to 12.

A drive motor 94 is secured on the inner surface of the side plate 62*a* of the trunk frame 62. An output shaft 95 of the motor 94 projects outward through the side plates 62*a*, and a pinion 96 is securely mounted at a projected end of the shaft 95. On the other hand, a guide rail 98 extending obliquely upward is secured on the outer surface of the side plate 62*a*. A rack 100 is slidably held by the guide rail 98 (i.e. such that it is permitted to make a linear movement). The rack 100 is in mesh with the pinion 96. Accordingly, by rotating the output shaft 95 in forward and reverse directions, the rack 100 makes a reciprocating linear movement.

The aforementioned pantograph type link mechanism 24 has a hinged extensible structure. Inner ends of a pair of link members 110 closest to the rack 100 amongst all link members forming the pantograph type link mechanism 24 are connected with the front end (left end in FIGS. 10 to 12) of the rack 100 via a pin 112. The link members 110 are each formed with a long through hole 116 extending in its longitudinal direction. On the other hand, pins 114 project from the outer surface of the side plate 62*a*. The pins 114 pass through the through holes 116 to fix the trace of rotation of the link members 110.

Accordingly, as the rack 100 makes a linear movement, both link members 110 follow the rack 100 together with the pin 112 while rotating about the pin 112. The rotation of the link members 110 causes the other link members to rotate. Thus, the link mechanism 24 is brought into a contracted state as shown in FIG. 11 and an extended state as shown in FIG. 12.

The link mechanism 24 is connected with the corresponding glove 26 via a glove mount bracket 120. The bracket 120 includes a glove mount plate 124 at its front end and a pair of link coupling plates 126 extending backward from the glove mount plate 124.

A glove mount portion 122 projects from the glove mount plate 124. The mount portion 122 has such a shape that the diameter of its leading end is larger than that of the other portions. The glove 26 is connected with the glove mount plate 124 by inserting the glove mount portion 122 into the glove 26.

A pair of link members 119 closest to the glove 26 in the link mechanism 24 are connected with the respective link coupling plates 126 in positions near the glove mount plate 124 such that they are rotatable with respect to each other via a pin 130 located at the inner ends of the link members 119.

Each link coupling plate 126 is formed with a long through hole 128 which linearly extends from a position right behind the pin 130 to a position near the rear end of the link coupling plate 126. A pin 132 located in the middle of the link members closest to the glove next to the link members 119 in the link mechanism 24 projects through the through holes 128. A disk 134 having a diameter larger than the width of the through holes 128 is mounted at the end of the pin 132 such that the pin 132 does not come out of the through holes 128. Accordingly, as the link mechanism 24 extends, the glove 26 moves obliquely upward, away from the dummy main body, and the pin 132 slides in the through holes 128.

In the link mechanism 24, the link members 110 and 119 at its opposite ends are arc-shaped and the intermediate link members between them are substantially S-shaped. More specifically, the respective link members 110, 118 and 119 are so formed such that juxtaposed link members, when in the extended position, have a generally outer convex configuration as shown in FIG. 12.

It does not particularly matter of which material the respective link members are formed, but it is preferable to use a material which is lightweight and has a high strength. Specifically, polyacetals are preferable.

A detection bracket 101 is secured on the outer surface of the rack 100, and a detection plate 102 projects from the upper end of the detection bracket 101 toward the side plate 62*a*. Two stroke sensors (extension detection means) 104 and 106 are arranged side by side in the moving direction of the rack 100 on the side plate 62*a*. Each stroke sensor includes a light emitting element 107 and a light receiving element 108 which are juxtaposed in the vertical direction. The detection plate 102 passes between the light emitting element 107 and the light receiving element 108 of each of the respective stroke sensors 104 and 106.

Upon blocking the light emitted from the light emitting element 107 to the light receiving element 108, the detection plate 102 has its presence detected by each of the stroke sensors 104 and 106. The stroke sensors 104 and 106 are disposed such that the detection plate 102 is detected by the stroke sensor 104 when the link mechanism 24 is in its most contracted state as shown in FIG. 11 while being detected by the stroke sensor 106 when the link mechanism 24 is in its most extended state as shown in FIG. 12.

Further in this game machine, in order to instruct the operation of the extension mechanisms from outside, a pair of extension switches 135 corresponding to the respective arms are provided. The extension switches 135 are disposed at the upper ends of the levers 72 (i.e. the upper ends of the grips 73) of the handle 18 (see FIGS. 4, 7B and 9B).

Next, a coupling construction for coupling the trunk frame 62 and the head frame 64 of the boxer dummy 16 is described with reference to FIGS. 13A and 13B.

Figure 13A:
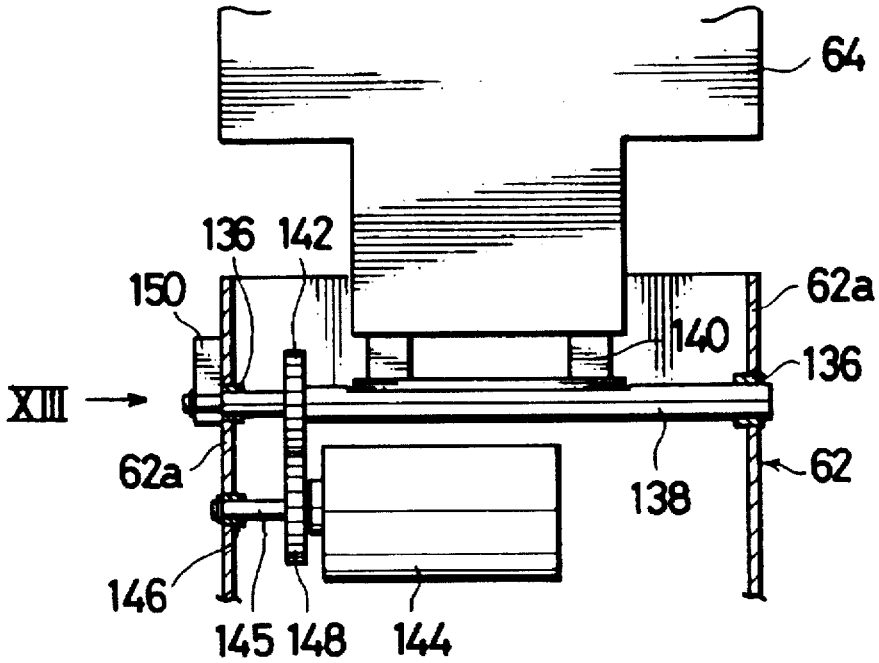
FIG. 13A is a rear view in section of a coupling structure for coupling a trunk frame and a head frame of the boxer dummy.

As shown in FIG. 13A, the opposite ends of a rotatable support shaft 138 are rotatably supported in the upper portions of the left and right side plates 62*a* of the trunk frame 62 via bearings 136. The bottom end of the head frame 64 is connected with a middle portion of the rotatable support shaft 138 via support bars 140.

A gear 142 is securely mounted in an intermediate position of the rotatable support shaft 138 such that it is not rotatable with respect to the rotatable support shaft 138. A drive motor 144 driven to move the head of the dummy is disposed below the rotatable support shaft 138, and an output shaft 145 thereof is rotatably supported by one side plate 62*a* via a bearing 146. A gear 148 is securely mounted on the output shaft 145 such that it is not rotatable with respect to the output shaft 145. The gear 148 is in mesh with the gear 142. Upon driving the motor 144, the head frame 64 rotates about the rotatable support shaft 138 (i.e. the dummy moves his head).

Figure 13B:
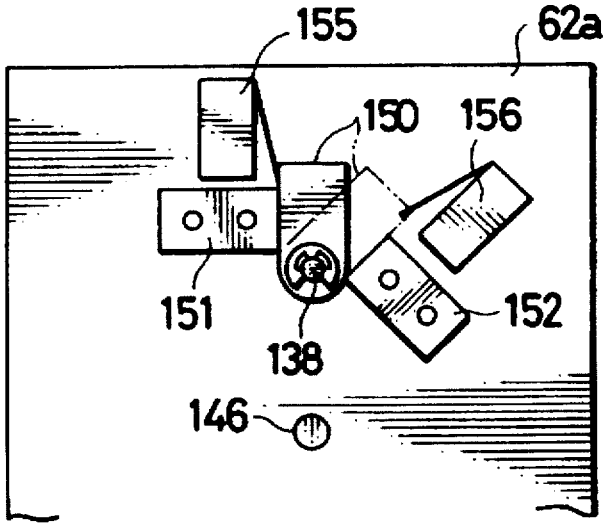
FIG. 13B is a view when viewed from the direction of arrow XIII of FIG. 13A.
Figure 14:
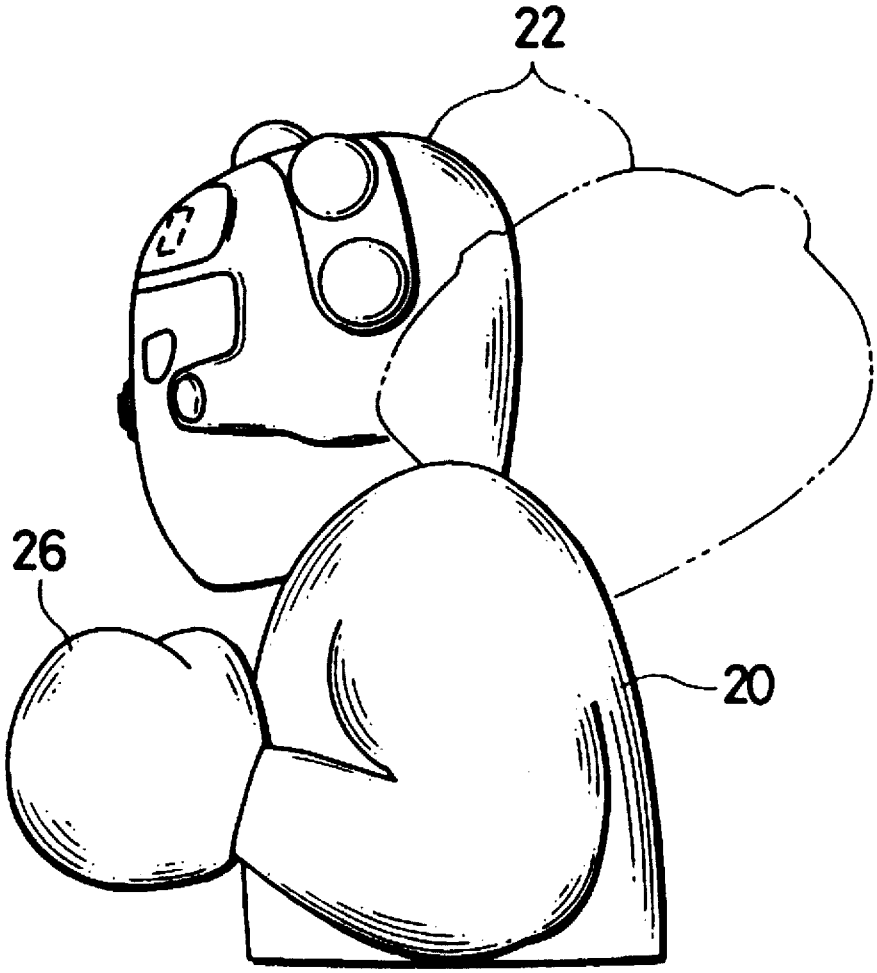
FIG. 14 is a side view showing a head moving movement of the boxer dummy.

As shown in FIG. 13B, a rotatable stopper 150 is securely mounted at one end of the rotatable support shaft 138 such that it is not rotatable with respect to the rotatable support shaft 138. A pair of fixed stoppers 151, 152 of urethane rubber or like material are secured on the outer surface of the side plate 62*a* on a trace of rotation of the rotatable stopper 150. Rotation ranges of the rotatable support shaft 138 and the head 22 are restricted between a position where the rotatable stopper 150 comes into contact with the fixed stopper 151 (a position where the head 22 faces forward as indicated at solid line in FIG. 14) and a position where the rotatable stopper 150 comes into contact with the fixed stopper 152 (a position where the head 22 leans back as indicated at phantom line in FIG. 14).

Limit switches 155 and 156 are also disposed on the outer surface of the side plate 62*a*. The limit switch 155 is disposed such that it is turned on upon contact with the rotatable stopper 150 when the rotatable stopper 150 comes into contact with the fixed stopper 151. The limit switch 156 is disposed such that it is turned on upon contact with the rotatable stopper 150 when the rotatable stopper 150 comes into contact with the fixed stopper 152.

Figure 15:
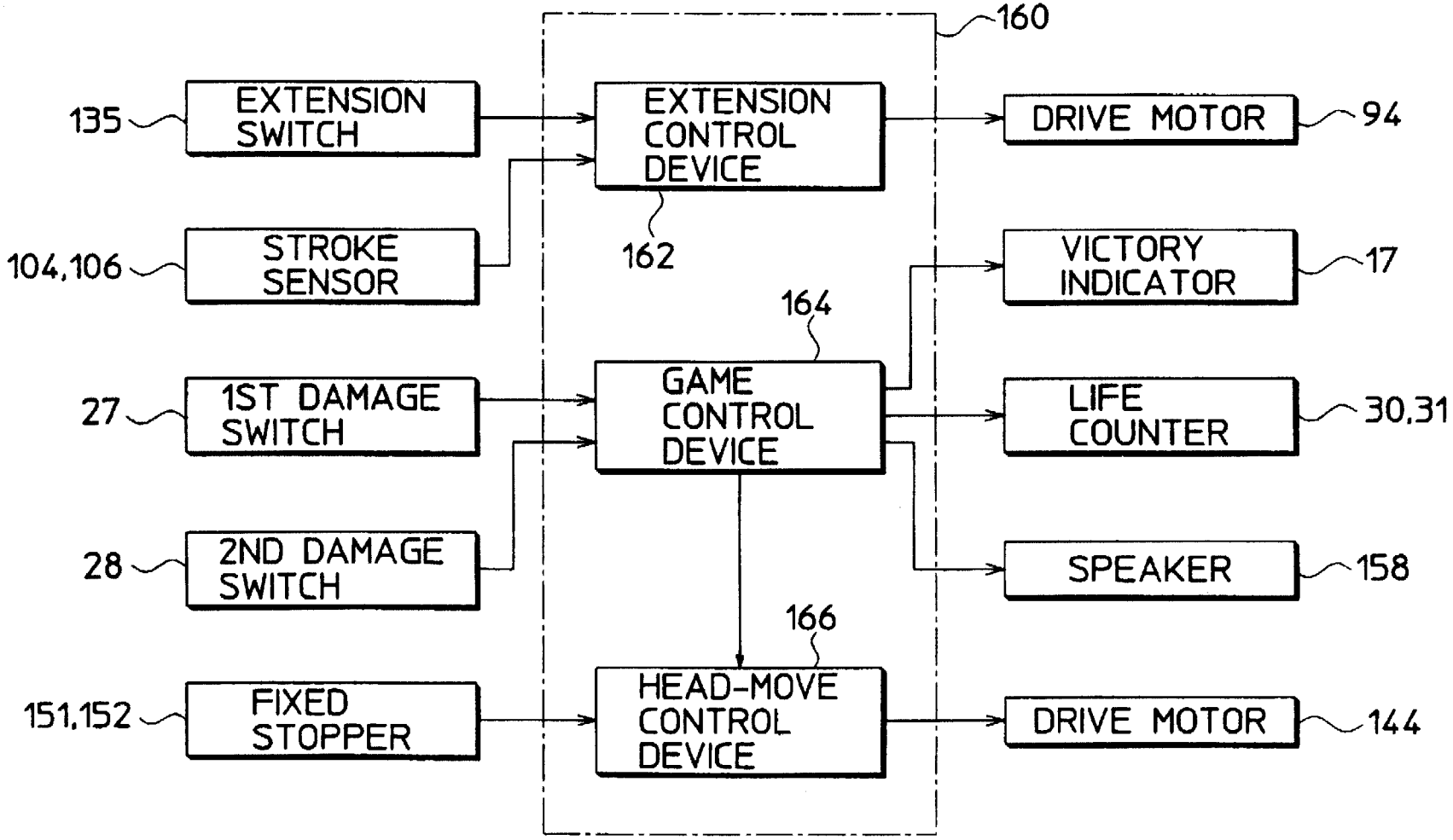
FIG. 15 is a block diagram showing the function of a controller provided in the game machine.

A controller 160 as shown in FIG. 15 is mounted in the game machine. The controller 160 includes a computer and is, as functions, provided with an extension control device 162, a game control device 164 and a head-move control device 166.

The extension control device 162 controls the driving of the motor 94 such that the rack 100 moves in the manners as described below in accordance with the operation of the extension switch 135.

Figure 10:
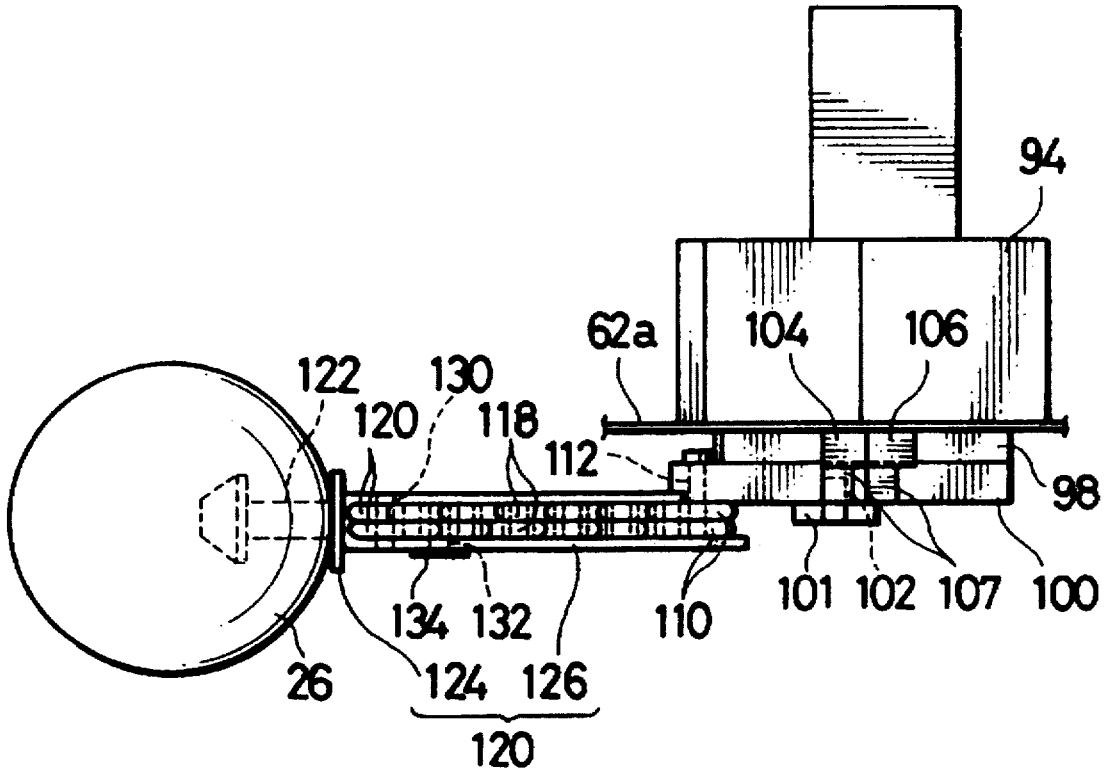
FIG. 10 is a view when viewed in the direction of arrow X of FIG. 11.
Figure 11:
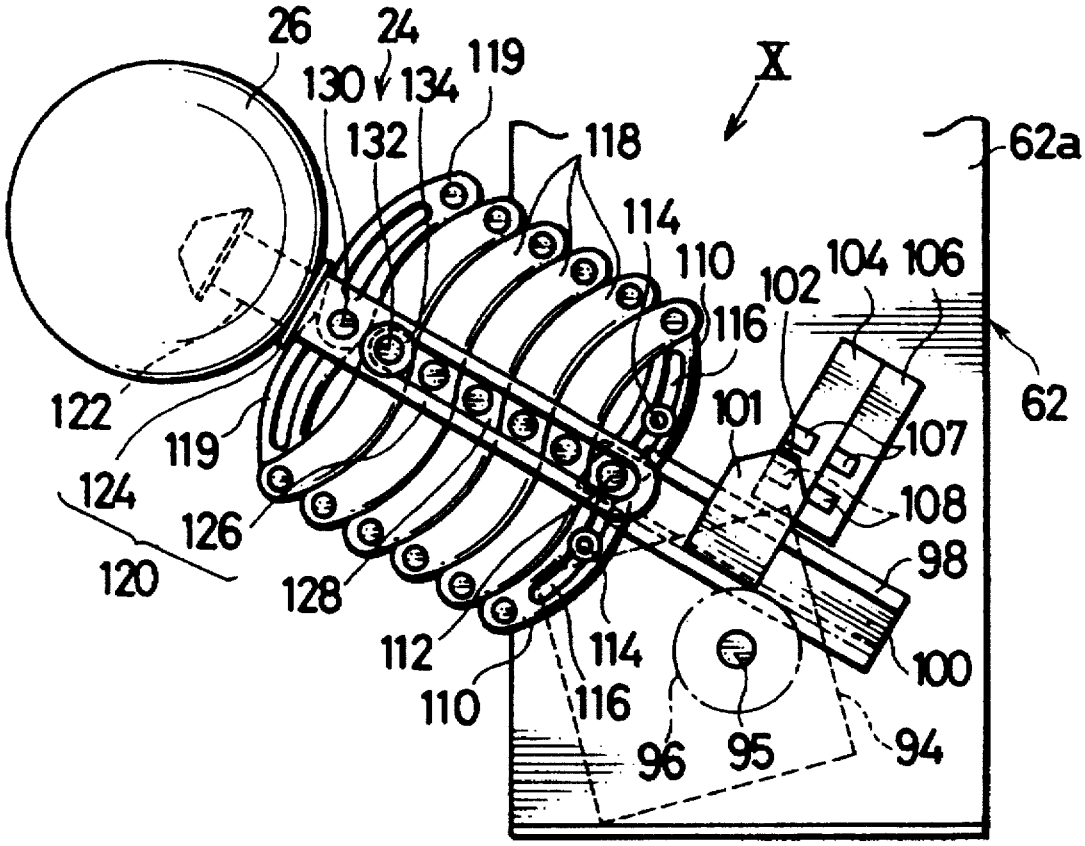
FIG. 11 is a side view showing a pantograph type link mechanism in its contracted state in the boxer dummy.

1) A normal state where the extension switch 135 is not operated:

The rack 100 is held in the position where the stroke sensor 104 detects the detection plate 102 as shown in FIGS. 10 and 11 (i.e. the link mechanism 24 is caused to contract).

Figure 12:
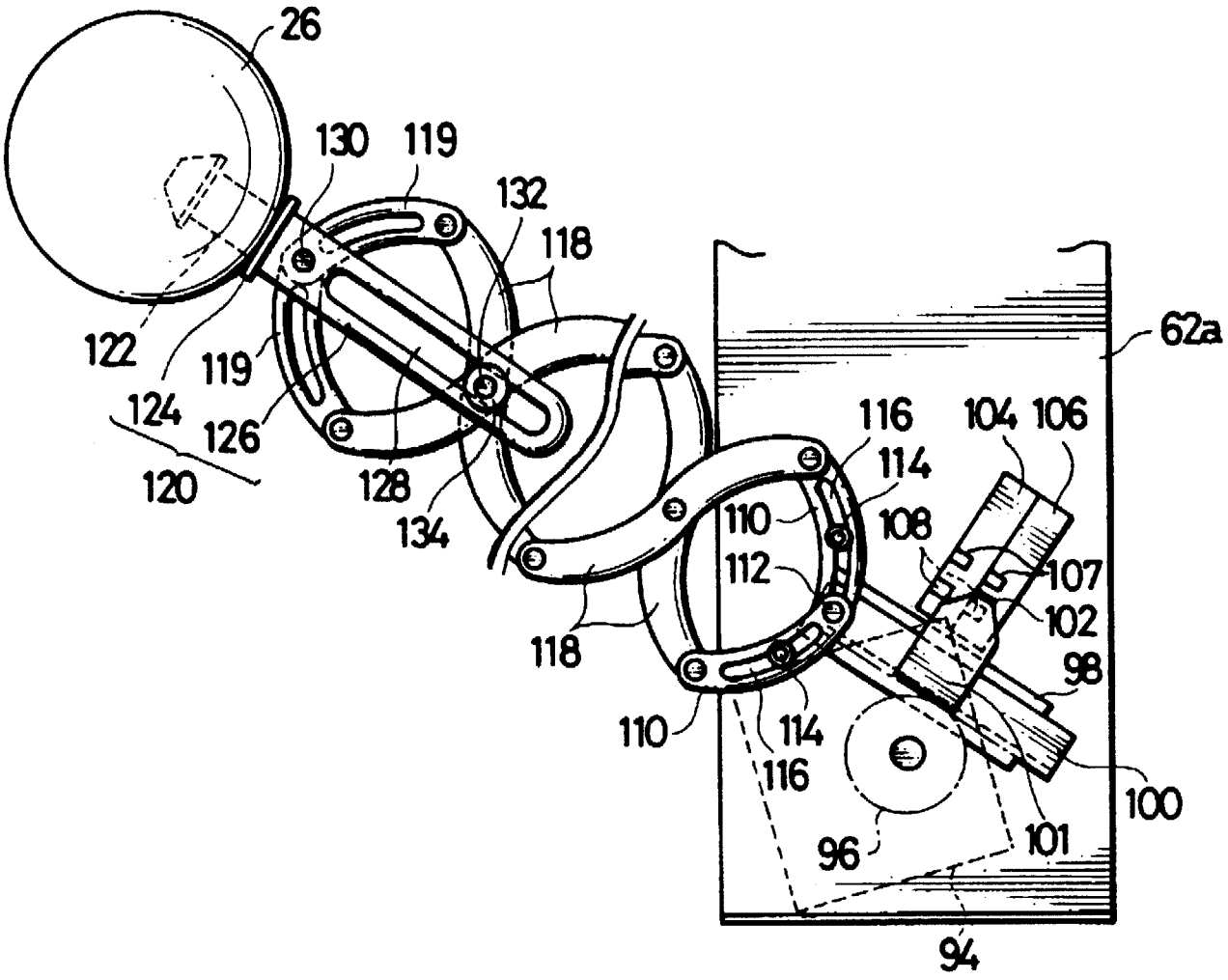
FIG. 12 is a side view showing the pantograph type link mechanism in its extended state in the boxer dummy.

2) Upon operation of the extension switch 135, the rack 100 is first caused to make a linear movement to the position where the stroke sensor 106 detects the detection plate 102 as shown in FIG. 12 (i.e., the link mechanism 24 is extended). Immediately thereafter, the rack 100 is quickly moved back to the position where the stroke sensor 104 detects the detection plate 102 (i.e., the link mechanism 24 is contracted again).

The game control device (discrimination means) 164 controls the progress of the game after a coin is inserted through the coin slot 19. The control operation of the game control device 164 is described in detail later.

The head-move control device 166 holds the rotatable support shaft 138 in an angular position where the limit switch 155 is turned on by the rotatable stopper 150 (i.e. the position where the head 22 faces forward) in a normal state where the control device 166 does not receive a KO (knock out) signal from the game control device 164. Upon receipt of the KO signal from the game control device 164, the control device 166 controls the driving of the motor 144 such that the rotatable support shaft 138 rotates to the position where the limit switch 156 is turned on by the rotatable stopper 150 (i.e. the position where the head 22 leans back).

Figure 16:
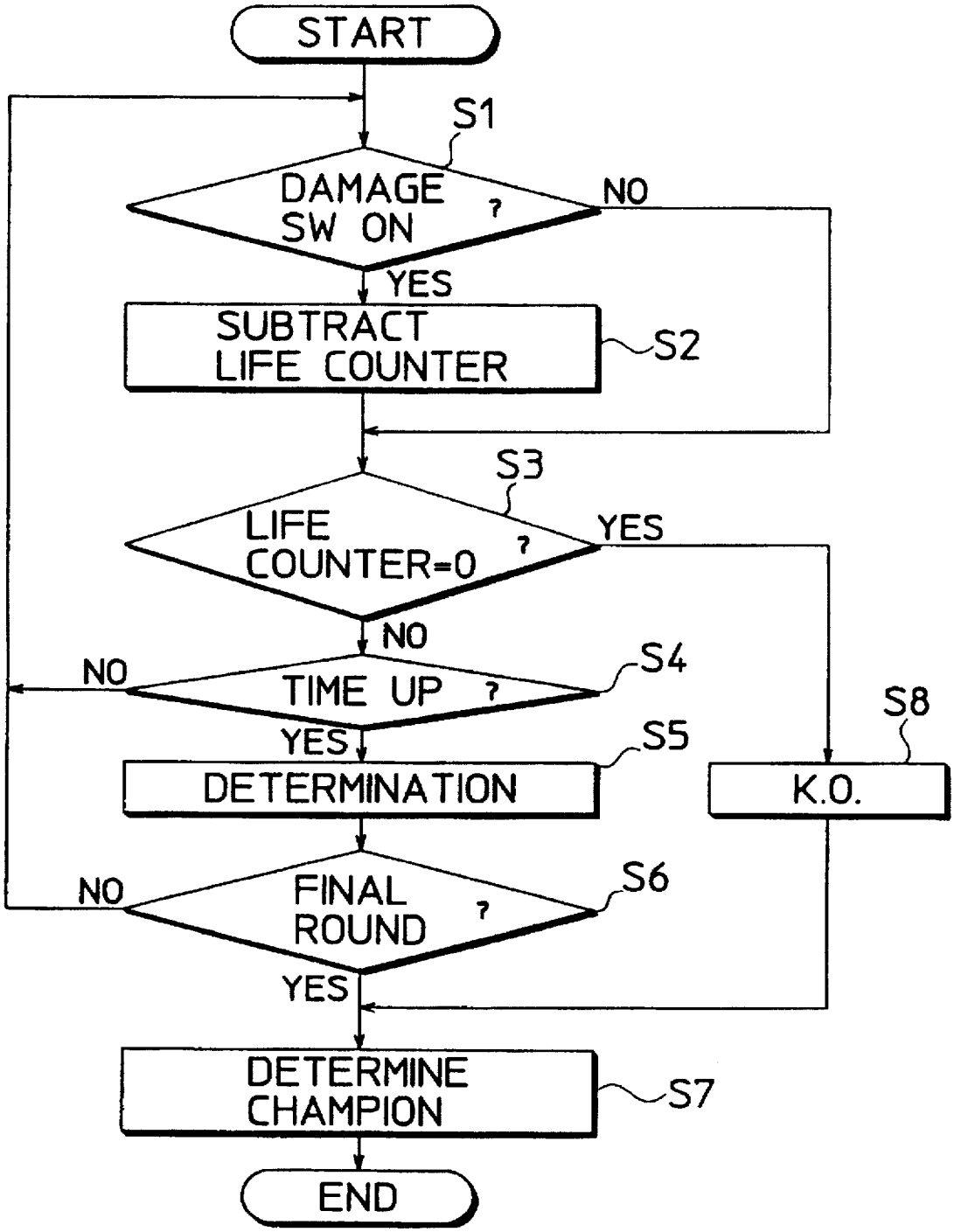
FIG. 16 is a flowchart showing how a game progresses under the control of the controller.

Next, the game progressed under the control of the game control device 164 is described with reference to a flowchart of FIG. 16.

A boxing game starts upon the insertion of a coin. In this embodiment, the game consists of the 1st to 3rd rounds, a time limit (e.g. 3 minutes) is set for each round. During each round, the player holds the left and right grips with his both hands. He can also operate the extension switches 135 provided on the grips 73, thereby extending the arm to give a punch. By leaning the handle 18 to the left and right, he can cause the boxer dummy 16 to lean to the left and right. Further, by rotating the handle 18 about the vertical axis, he can cause the boxer dummy 16 to be directed toward left and right. By moving the boxer dummy 16 as described above, the player can change a punching position and avoid a punch from the opponent.

In this game, it is better to hit the damage switches 27 and 28 of the boxer dummy 16 of the opponent. When the glove 26 hits the damage switch 27 (28) (YES in Step S1 of FIG. 16), the damage switch 27 (28) is turned on and lighted. At the same time, the detection signal representing that the damage switch 27 (28) has been hit is input to the game control device 164, which in turn the game control device 164 subtracts points corresponding to the hit damage switch 27 (28) from full points (e.g. 99 points) of the life counter of the hit boxer dummy 16 (Step S2).

In this embodiment, points subtracted when the first damage switch 27 corresponding to the nose is hit are set larger than the points subtracted when the second damage switches 28 corresponding to the cheeks is hit. Accordingly, in order to decrease the points in the life counter of the opponent faster, it is better to hit the first damage switch 27 rather than the second damage switches 28.

In the case that the game progresses as described above and the time limit elapses before the point in either one of the life counters reaches 0 (NO in Step S3 and YES in Step S4), the round ends and the boxer dummy 16 having more points is determined to have led in this round (Step S5) and a next round is started (Step S6). The lead determination result for each round is displayed in the respective winning/loss indicator 17.

If the final round (third round) ends before the point of either one of the life counters reaches 0 (YES in Step S6), the boxer dummy who led the opponent in more rounds is determined to be a champion (Step S7) and announcement and shout of joy are made audible through a loudspeaker shown in FIG. 15.

On the other hand, if the point of either one of the life counters reaches 0 during the round (YES in Step S3), the boxer dummy 16 corresponding this life counter is determined to have been knocked out (Step S8). His opponent is immediately determined to be a champion (Step S7) and the head 22 of the knocked out boxer dummy 16 is caused to lean back.

The above game machine has the following effects.

1) The simple construction in which the handle 18 is connected with the boxer dummy 16 via the rotary unit realizes a change of the posture of the boxer dummy 16 to the left and right. This movement enables the boxer dummy 16 to efficiently punch and defend. Further, since the extension switches 135 used to give a punch are provided on the handle 18, the player can perform the punching operation by pressing the extension switch 135 while changing the posture of the boxer dummy 16 by manipulating the handle 18. Thus, the player can enjoy a boxing game as if it were real.

2) Since the boxer dummy 16 rotates about the vertical axis when the handle 18 is rotated about the vertical axis, the player can direct the boxer dummy 16 toward the left and right as well as lean the posture thereof to the left and right while gripping the handle 18. Thus, the player is enabled to more efficiently punch and defend.

3) Each boxer dummy 16 is provided with the damage switches 27 and 28, and the points in the corresponding life counter is decreased based on the damage detection result. Which boxer dummy 16 has won is determined based on the points in the life counter. Accordingly, the players can enjoy a more exciting and thrilling game. Particularly, in this embodiment, the number of points decreased from the life count value differs depending on which damage switch was hit. This makes the game strategy more complicated, thereby enriching the content of the game. Further, when the life count value reaches 0, the boxer dummy 16 corresponding to this life counter is immediately determined to have been knocked out. This makes the game more thrilling. Furthermore, by changing the number of points to be decreased, a handicap can be given according to the player's ability.

4) By using the drive motor 144 and the rack/pinion mechanism, the pantograph type link mechanism 24 can be quickly extended and contracted when the extension switch 135 is operated. Accordingly, a punching operation which is almost identical to a real punching operation can be automatically reproduced, with the result that the players cain enjoy a boxing game more identical to a real game. This also prevents the arm from remaining extended.

In the foregoing embodiment, the drive shaft 70 provided in the handle 18 and the driven shaft 58 provided in the boxer dummy 16 are rotatably supported by the carriage housing 40, and the torque of the drive shaft 70 is transmitted to the driven shaft 58 by the pulley-belt torque transmission mechanism. However, according to the invention, it may be appreciated to use a link mechanism.

Figure 18:
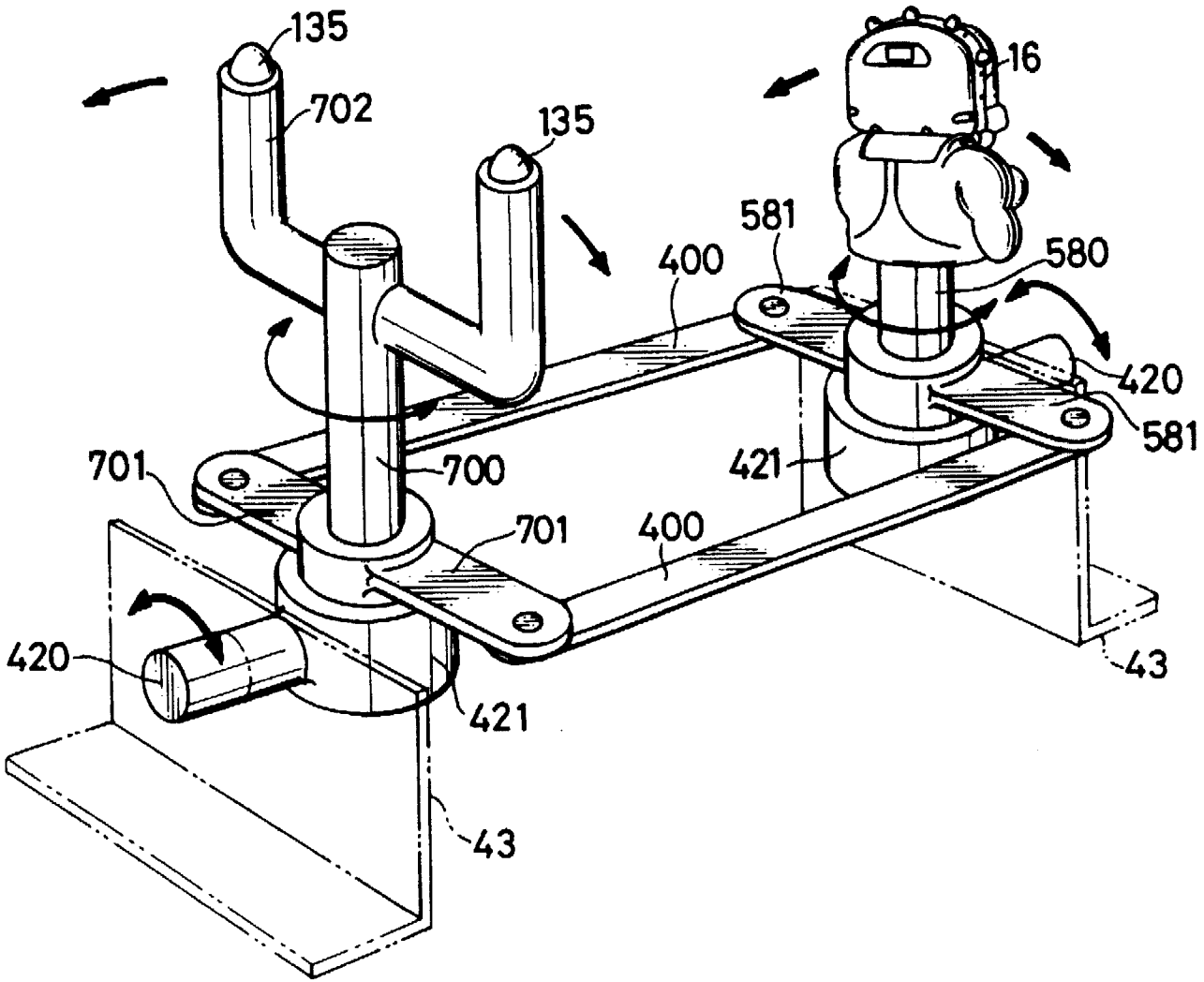
FIG. 18 is a perspective view showing another rotary unit and transmission mechanism used in the game machine.
Figure 19:
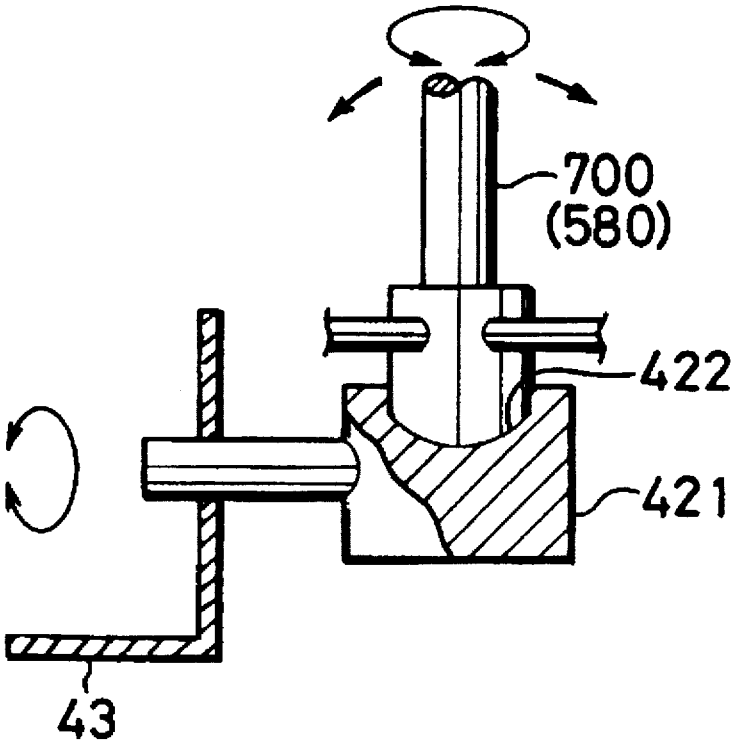
FIG. 19 is a partially sectional view showing a bearing portion of one rotatable support shaft of the rotary unit shown FIG. 18.

Referring now to FIG. 18 showing another rotary unit provided with a link transmission mechanism, two rotatable support shafts 420 are rotatably supported by brackets 43 mounted on a horizontal plate in the same manner as the foregoing embodiment. The respective axes of the two rotatable support shafts 420 are arranged on a substantially horizontal axis so that they are rotatable about the horizontal axis. On the respective outer ends of the two rotatable support shafts 420, further, there are provided a rotation regulation mechanism identical to that of the foregoing embodiment. On the other hand, the respective inner ends of the two rotatable support shafts 420 are formed with bearing portions 421. As shown in FIG. 19, the bearing portion 421 has a bore 422 in an upper portion thereof.

A drive shaft 700 is formed with connecting arms 701 projecting in opposite directions on a lower portion thereof and with a handle 702 projecting on an upper portion thereof. The connecting arms 701 and the handle 702 are arranged so as to pass the same vertical plane to ensure easy handling. Also, on tops of both grips of the handle 702 are provided extension switches 135 in the same manner as the foregoing embodiment. The drive shaft 700 is rotatably mounted in the bearing portion 421 of the rotatable support shaft 420 by placing a bottom end of the drive shaft 700 in the bore 422 formed in the bearing portion 421.

Similarly, a driven shaft 580 is formed with connecting arms 581 projecting in opposite direction on a lower portion thereof and is rotatably mounted in the bearing portion 421 of the other rotatable support shaft 420. The connecting arms 581 extends in parallel with the connecting arms 701. On a top of the driven shaft 580 is fixedly attached a boxer dummy 16 having extensible arms. The extension of the extensible arms of the boxer dummy 16 is performed by an extension mechanism identical to that of the foregoing embodiment.

The connecting arms 701 of the drive shaft 700 and the connecting arms 581 of the driven shaft 580 are connected with each other by link members 400, respectively. Both ends of each link member 400 are untightly connected with each of the connecting arms 701 and 581 by a pin. Accordingly, the drive and driven shafts 700 and 580 can freely rotate about their respective axes.

The driven shaft 580 and the drive shaft 700 are arranged on a vertical plane passing the player to give easy handling to the player. Also, this array will make it easier that the player pretends to be his/her boxer dummy.

In this way, the rotatable support shafts 420, the connecting arms 701 formed on the drive shaft 700, the connecting arms 581 formed on the driven shaft 580, and the link members 400 combinedly form a rotary unit. Also, the connecting arms 701 formed on the drive shaft 700, the connecting arms 581 formed on the driven shaft 580, and the link members 400 combinedly form a torque transmission mechanism.

Accordingly, by the way of the rotary unit, the player can desirably incline the boxer dummy 16 left or right merely by gripping the handle 702 and inclining the handle 702, or the drive shaft 700 left or right. Also, by the way of the torque transmission mechanism, the player can desirably rotate the boxer dummy 16 about its axis merely by rotating the drive shaft 700 about its axis.

In this embodiment, there is not provided the carriage housing 40 for carrying the operation handle 18 and the boxer dummy 16. Further, the link members 400 serves as both the part of the rotary unit and the part of the torque transmission mechanism. Accordingly, a main operative portion of the game machine can be constructed at a reduced number of parts, which will thus ensure light handling.

In this embodiment, the drive and driven shafts 700 and 580 are formed with the two connecting arms 701 and 581 and the two connecting arms 701 and 581 are connected by the two link members 400. However, it may be possible to form one connecting arm on each shaft and connect them by a single link member to reduce the number of parts and ensure more light handling.

Further, the invention is not limited to the aforementioned embodiments, but may be embodied, for example, as follows.

1) In the foregoing embodiment, the invention is applied to a dual player game machine in which the boxer dummies 16 are both connected with the rotary unit. However, the invention may be applied to a single player game machine in which only one of the boxer dummies 16 is connected with the rotary unit. In such a case: the other boxer dummy 16 may be automatically controlled by a controller or the like (i.e. the punching operation and the footwork of the dummy are automatically performed).

2) The invention may be applied to a game machine in which only one of the arms of the boxer dummy 16 is extensible and accordingly only a single extension switch is provided in the operative member. However, if both arms are extensible and a pair of left and right extension switches 135 corresponding to the both arms are provided on the pair of the grips 73 as in the foregoing embodiment, the player can easily operate the boxer dummy and the punching operation of the both arms at the same time while holding the grips 73 with both hands. Accordingly, they can enjoy a more exciting game.

Figure 17:
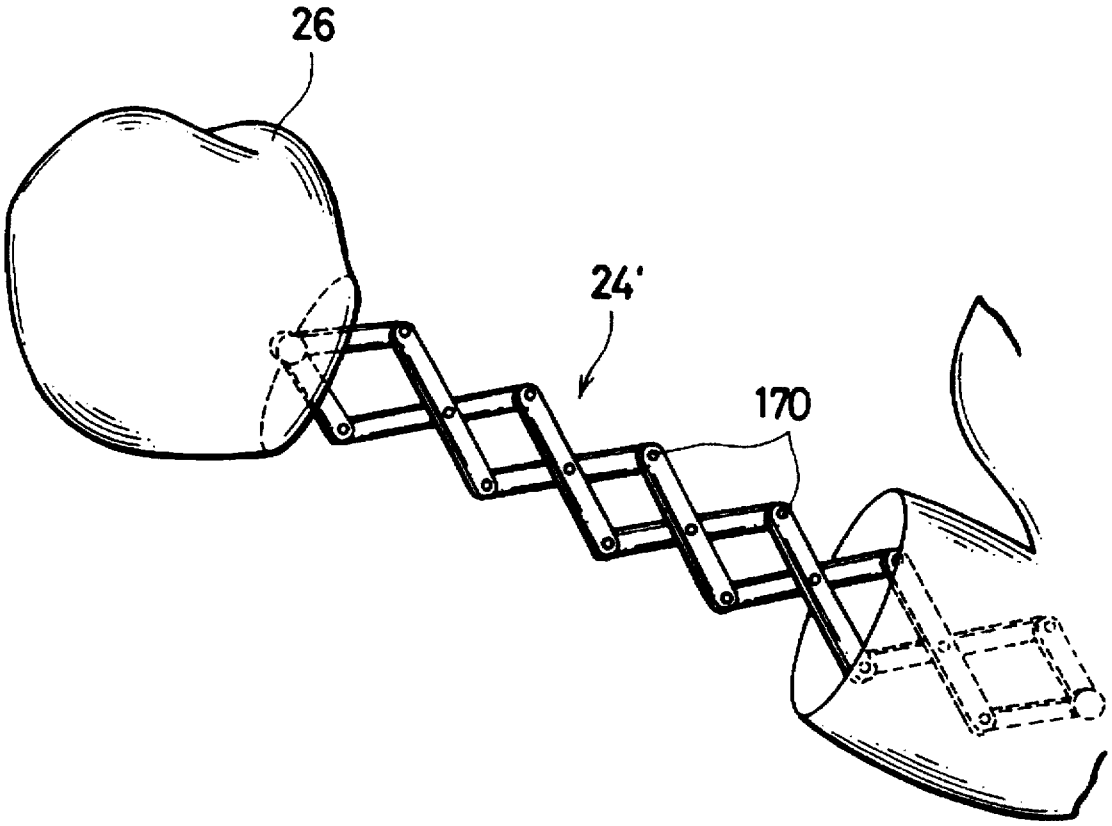
FIG. 17 is a side view of a modification of the pantograph type link mechanism.

3) A suitable known mechanism may be used as a mechanism for extending the arm in the invention. Even in the case where the pantograph type link mechanism is used, the shape of the respective link members is not particularly important. For example, a link mechanism 24' formed by linear link members as shown in FIG. 17 may be used. However, in this case, points of connection 170 where the ends of the respective members are connected become angular, and the arms of the dummies tend to get entangled at these portions. If the respective link members are shaped such that they form outward bulging curves when the link mechanism 24 is extended, points of connection where the respective link members are connected are allowed to be round (compare FIGS. 12 and 17). Accordingly, the probability that the arms get entangled can be considerably reduced, with the result that the game can more smoothly progress.

4) It may be appreciated to use a gear torque transmission mechanism instead of the pulley-belt torque transmission mechanism shown in FIG. 4.

As described above, the invention has the following effects.

As described above, according to the game machine of the invention, a pair of the boxer dummies are opposed to each other and the rotary unit is rotatably mounted in a game machine main body about the substantially horizontal axis. The boxer dummies and the operative member are connected with the rotary unit. Accordingly, a simple construction enables the boxer dummies to lean to the left and right. Further, by operating the extension switch provided on the operative member while gripping the operative member, the player can cause the arm of the boxer dummy to extend to give a punch while moving the boxer dummy, thereby enjoying an exciting boxing game which is very identical to a real game.

Further, since the boxer dummy and the operative member are rotatably connected with the rotary unit about the substantially vertical axis via the rotary unit, the boxer dummy can be rotated about the substantially vertical axis by rotating the operative member about the substantially vertical axis while gripping it. Accordingly, only by operating the operative member, the player is enabled to freely change the facing direction of the boxer dummy as well as to perform the punching operation and the leaning operation to the left and right. By changing the punching direction and avoiding a punch from the opponent, the boxing game can be made more exciting.

Particularly, with the pair of extension switches corresponding to both hands and provided on the corresponding grips of the operative member, the player can easily move the boxer dummy itself and perform the punching operation at the same time, while stably holding the grips with both hands.

When a punch given from one boxer dummy hits the position of the other boxer dummy where the damage detection means is provided, the damage detection means makes a detection and which boxer dummy won is determined based on its detection result. Accordingly, the player can enjoy a more exciting and thrilling boxing game.

Further, the damage points which differ depending on the position of the damage require a more complicated game strategy, thereby enriching the content of the game.

Furthermore, the pantograph type link mechanism is used to extend and contract the arm, and the arm of the boxer dummy is automatically extended and contracted by a specified stroke using the drive motor and the rack/pinion mechanism upon operation of the extension switch. Accordingly, a punching operation almost identical to a real punching operation can be automatically reproduced, making the boxing game more real. Further, this game machine securely prevents the arm from being kept extended.

Further, the link members constituting the link mechanism form outwardly bulging curves when the link mechanism is extended. With such link members, points of connection where the respective links are connected are allowed to be round, thereby decreasing a probability that the arms get entangled. As a result, the progress of the game can be made smoother.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A boxing game machine comprising:

a pair of boxer dummies opposed to each other;

at least one of the boxer dummies having at least one extensible arm;

an extender which drives the extension of the extensible arm;

a rotary unit which is rotatable about a substantially horizontal axis and carries at least one of the boxer dummies;

an operative member which is connected with the rotary unit and provided with a switch for actuating the extender to drive the extension of the arm, the operative member being operable to rotate the rotary unit about said horizontal axis;

the operative member being rotatable about a first substantially vertical axis;

said at least one boxer dummy being connected with the rotary unit and being rotatable about a second substantially vertical axis; and a transmission mechanism which transmits a torque of the operative member about the first substantially vertical axis to said at least one boxer dummy.

2. A boxing game machine according to claim 1, wherein:

the first substantially vertical axis and the second substantially vertical axis are on a vertical plane which contains the horizontal axis about which said rotary unit rotates.

3. A boxing game machine according to claim 1, wherein the transmission mechanism includes:

a drive shaft provided in the operative member and rotatably mounted on the rotary unit, the drive shaft extending along the first substantially vertical axis;

a driven shaft provided in the boxer dummy and rotatably mounted on the rotary unit, the driven shaft extending along the second substantially vertical axis;

a drive wheel fixedly attached to the drive shaft;

a driven wheel fixedly attached to the driven shaft; and a transmission member provided with the drive wheel and the driven wheel for transmitting a torque of the drive wheel to the driven wheel.

4. A boxing game machine according to claim 3, wherein:

the drive wheel is a drive pulley;

the driven wheel is a driven pulley; and the transmission member is a belt wound around the drive and driven pulleys.

5. A boxing game machine comprising:

a pair of boxer dummies opposed to each other;

at least one of the boxer dummies having at least one extensible arm;

an extender which drives the extension of the extensible arm;

a rotary unit which is rotatable about a substantially horizontal axis and carries at least one of the boxer dummies;

an operative member which is connected with the rotary unit and provided with a switch for actuating the extender to drive the extension of the arm, the operative member being operable to rotate the rotary unit about the horizontal axis;

the operative member being rotatable about a first substantially vertical axis;

said at least one boxer dummy being connected with the rotary unit and being rotatable about a second substantially vertical axis; and a transmission mechanism which transmits a torque of the operative member about the first substantially vertical axis to said at least one boxer dummy to rotate said at least one boxer dummy about the second substantially vertical axis in the same rotary direction as the rotation of the operative member about the first substantially vertical axis.

6. A boxing game machine according to claim 5, wherein:

the first substantially vertical axis and the second substantially vertical axis are on a vertical plane which contains the horizontal axis about which said rotary unit rotates.

7. A boxing game machine according to claim 5, wherein the transmission mechanism includes:

a drive shaft provided in the operative member and rotatably mounted on the rotary unit, the drive shaft extending along the first substantially vertical axis;

a driven shaft provided in said at least one boxer dummy and rotatably mounted on the rotary unit, the driven shaft extending along the second substantially vertical axis;

a drive wheel fixedly attached to the drive shaft;

a driven wheel fixedly attached to the driven shaft; and a transmission member provided with the drive wheel and the driven wheel for transmission a torque of the drive wheel to the driven wheel.

8. A boxing game machine according to claim 7, wherein:

the drive wheel is a drive pulley;

the driven wheel is a driven pulley; and the transmission member is a belt wound around the drive and driven pulleys.

9. A boxing game machine comprising:

a pair of boxer dummies opposed to each other;

at least one of the boxer dummies having at least one extensible arm having a non-extended position and an extended position, said extensible arm having a common longitudinal axis when in said non-extended position and when in said extended position;

an extender which drives the extension of the extensible arm along said common longitudinal axis;

a rotary unit which is rotatable about a substantially horizontal axis and carries at least one of the boxer dummies;

an operative member which is connected with the rotary unit and provided with a switch for actuating the extender to drive the extension of the arm, the operative member being operable to rotate the rotary unit about the horizontal axis;

the operative member being connected with the rotary unit and being rotatable about a first substantially vertical axis;

said at least one boxer dummy being connected with the rotary unit and being rotatable about a second substantially vertical axis; and a transmission mechanism which transmits a torque of the operative member about the first substantially vertical axis to said at least one boxer dummy.

10. A boxing game machine according to claim 9, wherein:

the first substantially vertical axis and the second substantially vertical axis are on a vertical plane which contains the horizontal axis about which said rotary unit rotates.

11. A boxing game machine according to claim 9, wherein the transmission mechanism includes:

a drive shaft provided in the operative member and rotatably mounted on the rotary unit, the drive shaft extending along the first substantially vertical axis;

a driven shaft provided in the boxer dummy and rotatably mounted on the rotary unit, the driven shaft extending along the second substantially vertical axis;

a drive wheel fixedly attached to the drive shaft;

a driven wheel fixedly attached to the driven shaft; and a transmission member provided with the drive wheel and the driven wheel for transmitting a torque of the drive wheel to the driven wheel.

12. A boxing game machine according to claim 11, wherein:

the drive wheel is a drive pulley;

the driven wheel is a driven pulley; and the transmission member is a belt wound around the drive and driven pulleys.

13. A boxing game machine comprising:

a pair of boxer dummies opposed to each other;

at least one of the boxer dummies having at least one extensible arm;

an extender which drives the extension of the extensible arm;

a rotary unit which is rotatable about a substantially horizontal axis and carries at least one of the boxer dummies;

an operative member which is connected with the rotary unit and provided with a switch for actuating the extender to drive the extension of the arm, the operative member being operable to rotate the rotary unit about the horizontal axis;

said rotary unit including a connecting portion which connects said at least one boxer dummy and the operative member; and two rotatable support shafts which are fixedly attached at two opposite ends of the connecting portion and rotatably supported on a support frame provided in the game machine, the respective axes of the two rotatable support shafts being on the substantially horizontal axis.

14. A boxing game machine according to claim 13, wherein:

the connecting portion includes:

a drive shaft provided in the operative member and mounted on the rotary unit, the drive shaft being rotatably about a first substantially vertical axis;

a driven shaft provided in the boxer dummy and mounted on the rotary unit, the driven shaft being rotatably about a second substantially vertical axis; and a transmission mechanism which connects the driven shaft and the driven shaft and transmits a torque of the drive shaft about the first substantially vertical axis to the driven shaft.

15. A boxing game machine according to claim 14, wherein:

the first substantially vertical axis and the second substantially vertical axis are in a plane substantially bisecting said at least one boxer dummy.

16. A boxing game machine according to claim 14, wherein:

the transmission mechanism includes:

a drive arm provided on the drive shaft;

a driven arm provided on the driven shaft;

a link member having two ends rotatably connected to the drive and driven arms, respectively.

17. A boxing game machine comprising:

a pair of boxer dummies opposed to each other;

at least one of the boxer dummies having at least one extensible arm;

the extensible arm including a pantograph type link mechanism which includes a plurality of link members and which is attached to a main body of the at least one boxer dummy;

an extender which drives the extension of the extensible arm;

the extender including a rack connected with a link member closest to the at least one boxer dummy amongst all link members of the link mechanism, the rack being reciprocatingly movable in a straight line to contract and extend the link mechanism;

a pinion in mesh with the rack;

a drive motor for rotating the pinion to move the rack;

an extension detector which detects an extended state of the link mechanism;

an extension controller which controls the drive motor in accordance with a detection signal of the extension detector to:

contract the link mechanism when the switch is not operated, and extend the link mechanism by a specified stroke and to contract immediately thereafter when the switch is operated;

a rotary unit which is rotatable about a substantially horizontal axis and carries the at least one boxer dummy; and an operative member which is connected with the rotary unit and provided with a switch for actuating the extender to drive the extension of the arm, the operative member being operable to rotate the rotary unit about the horizontal axis.

18. A boxing game machine according to claim 17, wherein the respective link members of the link mechanism are formed with a curved configuration such that a pair of juxtaposed link members have an outer convex configuration when the linked mechanism is extended.

19. A boxing game machine comprising:

a pair of boxer dummies opposed to each other;

at least one of the boxer dummies having at least one arm, said boxer dummy being rotatable about a first substantially vertical axis;

an actuator which actuates the arm;

a rotary unit which is rotatable about a substantially horizontal axis and carries at least one of the boxer dummies;

an operative member connected with the rotary unit and rotatable about a second substantially vertical axis, the operative member being operable to rotate the rotary unit about the horizontal axis; and transmission means which transmits a torque of the operative member to said at least one boxer dummy to rotate the boxer dummy in the same rotary direction as the operative member.

20. A boxing game machine according to claim 19 wherein the distance between the first and second vertical axes is substantially constant during operation of the boxing game machine.

21. A boxing game machine according to claim 19 wherein said at least one boxer dummy includes a head part and a torso part overlying said torso part, and pivotal means pivotably mounting said head part on said torso part.

22. A boxing game machine according to claim 21 wherein said pivotal means provides for pivotal movement of said head part relative to said torso part about a substantially horizontal axis.

23. A boxing game machine according to claim 21 further comprising drive means for effecting pivotal movement of said head part relative to said torso part.

* * * * *